US011859859B2

(12) United States Patent
Yonehara et al.

(10) Patent No.: US 11,859,859 B2
(45) Date of Patent: Jan. 2, 2024

(54) OUTDOOR UNIT FOR AIR-CONDITIONING APPARATUS

(71) Applicant: Mitsubishi Electric Corporation, Tokyo (JP)

(72) Inventors: Kentaro Yonehara, Tokyo (JP); Hiroyuki Jinnai, Tokyo (JP); Takashi Ikeda, Tokyo (JP); Shingo Hamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 285 days.

(21) Appl. No.: 17/295,530

(22) PCT Filed: Jan. 29, 2019

(86) PCT No.: PCT/JP2019/002920
§ 371 (c)(1),
(2) Date: May 20, 2021

(87) PCT Pub. No.: WO2020/157824
PCT Pub. Date: Aug. 6, 2020

(65) Prior Publication Data

US 2022/0018573 A1 Jan. 20, 2022

(51) Int. Cl.
*F24F 13/24* (2006.01)
*F24F 1/18* (2011.01)
*F24F 13/30* (2006.01)

(52) U.S. Cl.
CPC ..... *F24F 13/24* (2013.01); *F24F 1/18* (2013.01); *F24F 13/30* (2013.01)

(58) Field of Classification Search
CPC ..... F24F 1/14; F24F 13/24; F24F 1/18; F24F 13/30; F24F 1/48; F24F 1/16
See application file for complete search history.

(56) References Cited

U.S. PATENT DOCUMENTS 5,588,301 A * 12/1996 Deroche, Sr. ..... B60H 1/262 62/61
2016/0146217 A1* 5/2016 Tadokoro ..... F04D 29/547 415/121.2

FOREIGN PATENT DOCUMENTS

CN 108266839 A * 7/2018 ..... F24F 13/28
EP 3073202 A1 9/2016
(Continued)

OTHER PUBLICATIONS

Office Action dated Dec. 5, 2022 issued in corresponding DE Patent Application No. 112019006755.9 (and English translation).
(Continued)

*Primary Examiner* — Harry E Arant
(74) *Attorney, Agent, or Firm* — POSZ LAW GROUP, PLC

(57) ABSTRACT

An outdoor unit for an air-conditioning apparatus includes a casing having an air inlet through which air enters the casing, an air-sending device disposed in the casing and configured to create a flow of air passing through the air inlet, a heat exchanger disposed between the casing and the air-sending device and exposed through the air inlet and including a plurality of fins spaced apart from each other, and a partition disposed in the casing and dividing a space in the casing into an air-sending device chamber containing the heat exchanger and the air-sending device and a machine chamber containing a compressor. The plurality of fins include an end fin group located at an end remote from the partition. The casing includes a wall having at least one vent that faces the end fin group and that is located along a side edge part defining an edge of the air inlet.

11 Claims, 13 Drawing Sheets

(56) References Cited

FOREIGN PATENT DOCUMENTS

| | | | | |
|---|---|---|---|---|
| JP | H05-306823 | A | | 11/1993 |
| JP | 2010-060159 | A | | 3/2010 |
| JP | 2015-098995 | A | | 11/2013 |
| JP | 2017-083141 | A | | 5/2017 |
| JP | 2017-122548 | A | | 7/2017 |
| KR | 20040061895 | A | * | 7/2004 |
| WO | 2018/078836 | A1 | | 5/2018 |

OTHER PUBLICATIONS

International Search Report of the International Searching Authority dated Apr. 2, 2019 for the corresponding International application No. PCT/JP2019/002920 (and English translation).

* cited by examiner

Comparative Example

Comparative Example

OUTDOOR UNIT FOR AIR-CONDITIONING APPARATUS

CROSS REFERENCE TO RELATED APPLICATION

This application is a U.S. national stage application of PCT/JP2019/002920 filed on Jan. 29, 2019, the contents of which are incorporated herein by reference.

TECHNICAL FIELD

The present disclosure relates to an outdoor unit for an air-conditioning apparatus.

BACKGROUND ART

A typical outdoor unit for an air-conditioning apparatus includes a heat exchanger in a casing, and the casing has an air inlet through which the heat exchanger is exposed and through which air flowing from the outside of the casing into the casing passes to exchange heat with refrigerant flowing through the heat exchanger (refer to Patent Literature 1, for example).

CITATION LIST

Patent Literature

Patent Literature 1: Japanese Unexamined Patent Application Publication No. 2015-98995

SUMMARY OF INVENTION

Technical Problem

Patent Literature 1 discloses an outdoor unit including a heat exchanger including fins. At an end of the heat exchanger in a fin arrangement direction in which the fins are arranged, part of air entering a casing through an air inlet does not pass through spaces between the fins of the heat exchanger, and flows through a gap between the casing and the heat exchanger in the fin arrangement direction. The flow of air passing through the gap between the casing and the heat exchanger in the fin arrangement direction may cause turbulence of the air or vortices of air at the edges of the fins, generating noise, such as high-pitched sound like a peep, in the outdoor unit disclosed in Patent Literature 1. In particular, in recent years, heat exchangers having a smaller pitch of fins, or a smaller distance between the fins, than related-art heat exchangers have been developed to increase heat exchange capacity. If an outdoor unit includes such a heat exchanger, in which air flows less easily through the spaces between the fins than those of the related-art heat exchangers, the air will tend to flow through a gap between the heat exchanger and a casing in the fin arrangement direction because the gap is wider than each space between the fins and has a lower air flow resistance, so that the outdoor unit is more likely to generate air-induced noise.

The present disclosure is intended to solve the above-described problem and aims to provide an air-conditioning-apparatus outdoor unit that does not generate noise induced by air that enters a casing through an air inlet.

Solution to Problem

An embodiment of the present disclosure provides an outdoor unit for an air-conditioning apparatus, the outdoor unit including a casing having an air inlet through which air enters the casing; an air-sending device disposed in the casing and configured to create a flow of air passing through the air inlet; a heat exchanger disposed between the casing and the air-sending device and exposed through the air inlet, the heat exchanger including a plurality of fins spaced apart from each other; and a partition disposed in the casing and dividing a space in the casing into an air-sending device chamber containing the heat exchanger and the air-sending device and a machine chamber containing a compressor. The plurality of fins include an end fin group located at an end remote from the partition. The casing includes a wall having at least one vent that faces the end fin group and that is located along a side edge part defining an edge of the air inlet.

Advantageous Effects of Invention

In the outdoor unit for an air-conditioning apparatus according to an embodiment of the present disclosure, suction air entering the outdoor unit through the vent flows straight through spaces between the fins. This flow causes suction air entering the casing through the air inlet to hardly enter a gap between the side edge part of the air inlet and the fins that has a higher air flow resistance than does the vent. As a result, the suction air is kept from flowing through a gap between the casing and the heat exchanger in a direction in which the fins are arranged, thus reducing or eliminating turbulence of the air or vortices of air. Thus, the outdoor unit does not generate noise induced by air that enters the casing through the air inlet. Furthermore, even if suction air enters the gap between the side edge part and the fins, suction air passing through the vent and flowing straight will interrupt the flow of suction air in the direction in which the fins are arranged. As a result, the suction air is kept from flowing through the gap between the casing and the heat exchanger in the direction in which the fins are arranged, thus reducing or eliminating turbulence of the air or vortices of air. Thus, the outdoor unit does not generate noise induced by air that enters the casing through the air inlet.

DESCRIPTION OF EMBODIMENTS

Outdoor units 100 and 300 for an air-conditioning apparatus in the present disclosure will be described in detail below with reference to the drawings. Note that the relationship between the sizes of components in the following drawings may differ from that between the actual sizes of the components. Furthermore, note that components designated by the same reference signs in the following drawings are the same components or equivalents. This note applies to the entire description herein. Additionally, note that the forms of components described herein are intended to be illustrative only and the forms of the components are not intended to be limited to those described herein. For the sake of clarity, terms representing directions or positions, such as "upper", "lower", "rightward", "leftward", "front", and "rear", will be used as appropriate. These terms are used herein only for the purpose of convenience of description and are not intended to limit the arrangement and orientations of units or parts.

Embodiment 1

[Configuration of Outdoor Unit 100]

Figure 1:
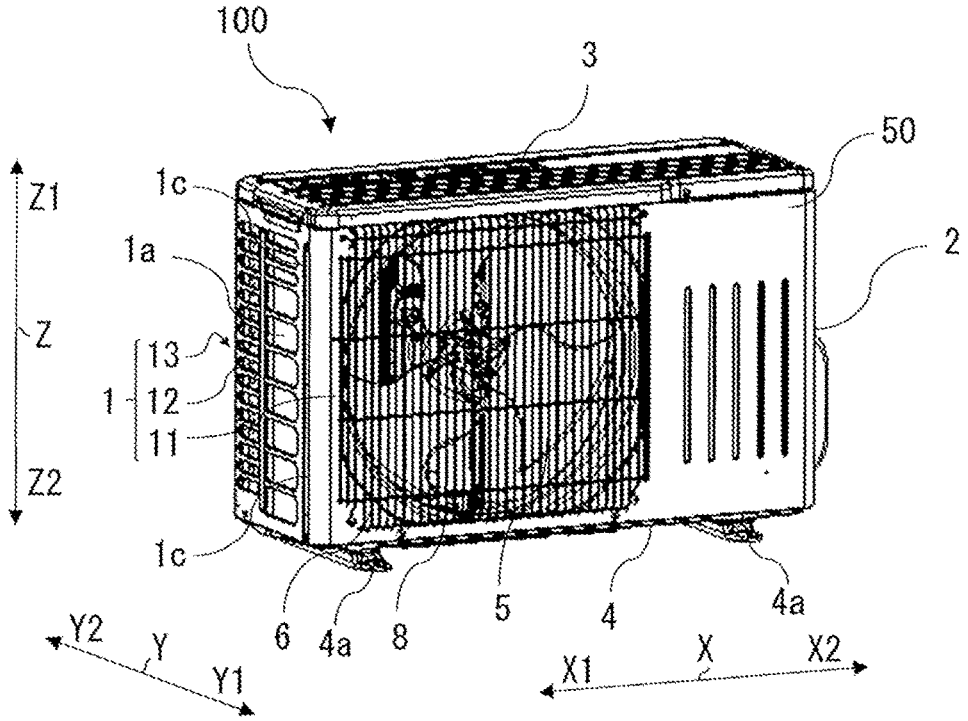
FIG. 1 is a front perspective view of an outdoor unit according to Embodiment 1 of the present disclosure.
Figure 2:
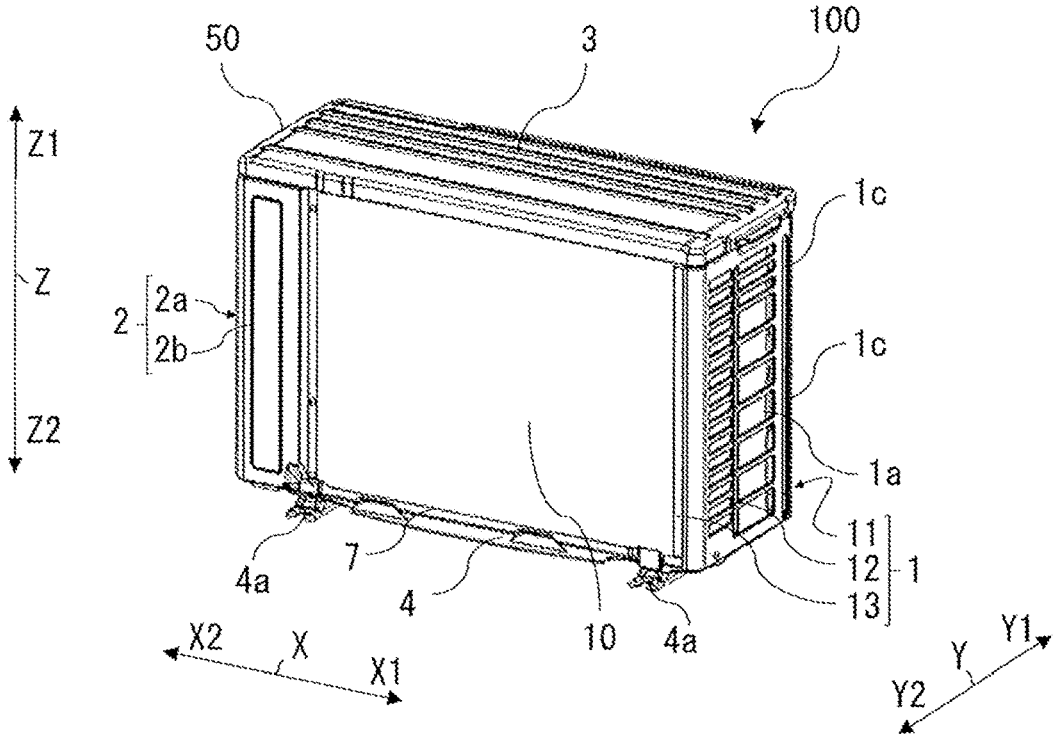
FIG. 2 is a rear perspective view of the outdoor unit according to Embodiment 1 of the present disclosure.
Figure 3:
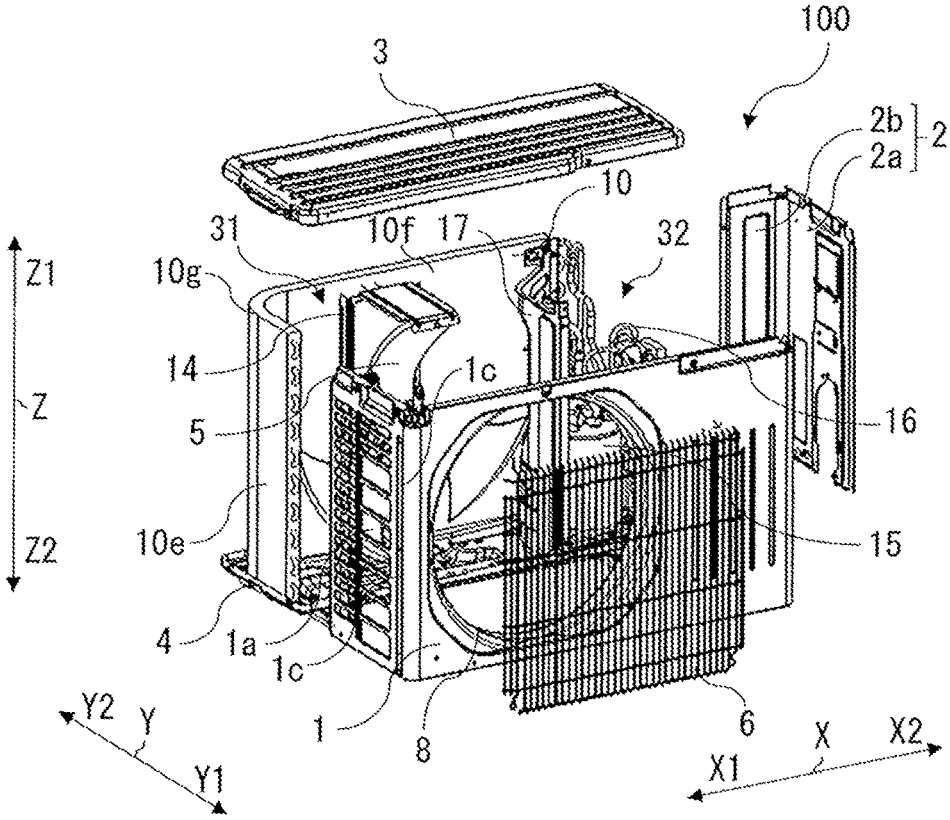
FIG. 3 is a partly exploded perspective view of the outdoor unit according to Embodiment 1 of the present disclosure.

FIG. 1 is a front perspective view of an outdoor unit 100 according to Embodiment 1 of the present disclosure. FIG. 2 is a rear perspective view of the outdoor unit 100 according to Embodiment 1 of the present disclosure. FIG. 3 is a partly exploded perspective view of the outdoor unit 100 according to Embodiment 1 of the present disclosure. The outdoor unit 100 for an air-conditioning apparatus will be described with reference to FIGS. 1 to 3. As illustrated in the following drawings including FIG. 1, the X axis represents the direction of width of the outdoor unit 100, the Y axis represents the direction of depth of the outdoor unit 100, and the Z axis represents the direction of height of the outdoor unit 100. More specifically, the term "X1 direction" refers to a leftward direction when the outdoor unit 100 is viewed from the front, the term "X2 direction" refers to a rightward direction, the term "Y1 direction" along the Y axis refers to a forward direction, the term "Y2 direction" refers to a rearward direction, the term "Z1 direction" along the Z axis refers to an upward direction, and the term "Z2 direction" refers to a downward direction in the following description about the outdoor unit 100. The phrase "when the outdoor unit 100 is viewed from the front" means a state of the outdoor unit 100 viewed from a downstream location, toward which air is blown from a casing 50, in an air flow direction in which the air flows through the casing 50. The positional relationship between components (in the direction of height, for example) described herein, in principle, is provided in a state where the outdoor unit 100 is placed in position ready for use.

(Shell of Outdoor Unit 100)

As illustrated in FIG. 1, the outdoor unit 100 includes the casing 50, which has a substantially rectangular cuboid shape. The casing 50 of the outdoor unit 100 is made of sheet metal and constitutes a shell of the outdoor unit 100. The casing 50 of the outdoor unit 100 includes a shell panel 1, a side panel 2, a top panel 3, and a base 4. Each of the shell panel 1 and the side panel 2 includes a flange at its top. The top panel 3 is attached to the flanges. Similarly, the base 4 also includes a flange. The shell panel 1 and the side panel 2 are secured to the flange with, for example, bolts, so that the shell panel 1 and the side panel 2 are placed on and combined with the base 4.

The shell panel 1 is a sheet metal panel. The shell panel 1 includes a front portion 11, a side portion 12, and a rear portion 13, which are integrated in one piece. The front portion 11 constitutes a front wall of the casing 50, the side portion 12 constitutes a side wall of the casing 50, and the rear portion 13 constitutes a part of a rear wall of the casing 50. The shell panel 1 is bent to have an L-shape defined by the front portion 11, which is horizontally long, and the side portion 12, which is vertically long, when the shell panel 1 is viewed from above the outdoor unit 100, that is, toward the position where the top panel 3 is disposed. Although the front portion 11 and the side portion 12 of the shell panel 1 are integrated in one piece, the shell panel 1 may have any other form. The shell panel 1 may be composed of a plurality of sheet metal panels such that the front portion 11 and the side portion 12 are separate panels.

The front portion 11 constitutes a wall of the casing 50 from which air is blown to the outside. The front portion 11 has a circular air outlet 8. An air-sending device 5 causes air to be suctioned into the casing 50 through a rear opening 7 and side openings 1*a*, which will be described later, and then blown out of the casing 50 through the air outlet 8. Furthermore, a rectangular fan guard 6 is attached to the front portion 11 of the shell panel 1 to cover the air outlet 8 and protect a propeller fan 5*b*, which will be described later, of the air-sending device 5.

Figure 4:
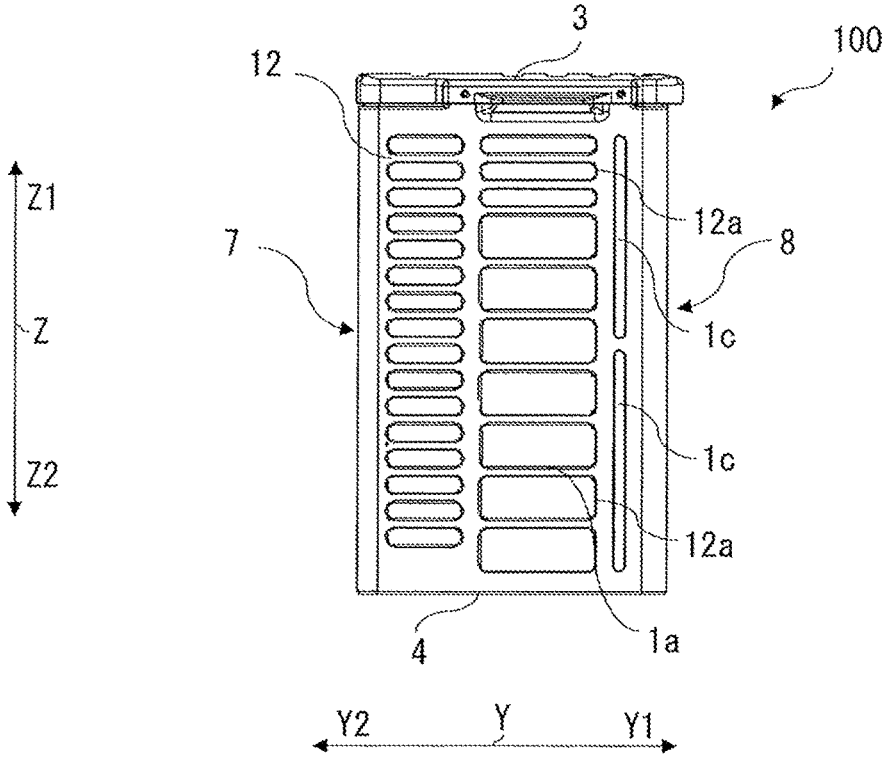
FIG. 4 is a side view of the outdoor unit according to Embodiment 1 of the present disclosure.

FIG. 4 is a side view of the outdoor unit 100 according to Embodiment 1 of the present disclosure. The side portion 12 will be described below with reference to FIG. 4. The side portion 12 constitutes a wall extending in the direction of depth of the casing 50 (along the Y axis). The side portion 12 has the side openings 1*a* to suction outdoor air into the outdoor unit 100. As illustrated in FIG. 4, the side openings 1*a*, each used as an air inlet, are arranged in the direction of height, or vertically, in the side portion 12. The number of side openings 1*a* in the side portion 12 may be one or more. The side openings 1*a* are used as air inlets in the casing 50 through which air is caused to enter the casing 50 from the outside by actuating the air-sending device 5. The side portion 12 further has a vent 1*c*. At least one vent 1*c* is located along side edge parts 12*a* of the side openings 1*a* in the side portion 12. The side portion 12 having the vent 1*c* faces a partition 17 with a heat exchanger 10 interposed between the vent 1*c* and the partition 17 and constitutes a side wall of an air-sending device chamber 31, and the side wall is opposite the partition 17. The side portion 12 and the vent 1*c* will be described in detail later.

With reference again to FIGS. 1 to 3, the rear portion 13 constitutes a part of the rear of the casing 50 and partly covers the rear of the heat exchanger 10. The rear portion 13 faces a part of the front portion 11 in the direction of depth of the casing 50 (along the Y axis). The shell panel 1 includes the front portion 11, the side portion 12, and the rear portion 13 integrated in one piece. The shell panel 1 is bent to have an L-shape defined by the side portion 12 and the rear portion 13 when the shell panel 1 is viewed from above the outdoor unit 100, that is, toward the position where the top panel 3 is disposed. The rear portion 13 extends from the side portion 12 to a position where the rear portion 13 partly covers the rear of the heat exchanger 10. Although the shell panel 1 is bent and the side portion 12 and the rear portion 13 are integrated in one piece, the shell panel 1 may have any other form. The shell panel 1 may be composed of a plurality of sheet metal panels such that the side portion 12 and the rear portion 13 are separate panels.

The rear portion 13 constitutes a part of the rear of the casing 50 and partly covers the heat exchanger 10, thus defining an edge of the rear opening 7 through which to expose the heat exchanger 10 at the rear of the casing 50. More specifically, the rear opening 7 is defined by respective edges of the rear portion 13, the top panel 3, the side panel 2, and the base 4. The rear opening 7 is used as an air inlet of the casing 50. Actuating the air-sending device 5 causes air to enter the casing 50 from the outside through the rear opening 7. To improve ventilation of the heat exchanger 10, the rear opening 7 has a greater width than does the rear portion 13.

The side panel 2 is a sheet metal panel bent in an L-shape when the side panel 2 is viewed toward the position where the top panel 3 is disposed. The side panel 2 includes a second side part 2*a*, which is vertically long and faces the side portion 12, and a second rear part 2*b* facing a part of the front portion 11. The second side part 2*a* constitutes a side wall of the casing 50. The second rear part 2*b* constitutes a part of the rear wall of the casing 50. The second rear part 2*b* and the rear portion 13 constitute the rear wall of the casing 50. Although the second rear part 2*b* and the rear portion 13 are separate pieces of the casing 50, the second rear part 2*b* and the rear portion 13 may be integrated in one piece to constitute the rear wall of the casing 50.

The second side part 2*a* has a plurality of openings (not illustrated) through which to draw a refrigerant pipe and a plug connected to an external power source into the casing. Although the second side part 2*a* and the second rear part 2*b* of the side panel 2 are integrated in one piece, the side panel 2 may have any other form. The second side part 2*a* and the second rear part 2*b* may be separate pieces, or two sheet metal panels.

The top panel 3 is a sheet metal panel that constitutes the top of the casing 50 and that is used as a top cover of the outdoor unit 100. The top panel 3 is attached to upper edges of the shell panel 1 and the side panel 2.

The base 4 is opposite the top panel 3 in the casing 50 and constitutes the bottom of the casing 50. The base 4, to which the shell panel 1 and the side panel 2 are attached, has a plurality of legs 4*a* extending from its lower surface. The legs 4*a* are used as supports by which to fix the outdoor unit 100 to an installation location.

(Internal Configuration of Outdoor Unit 100)

Figure 5:
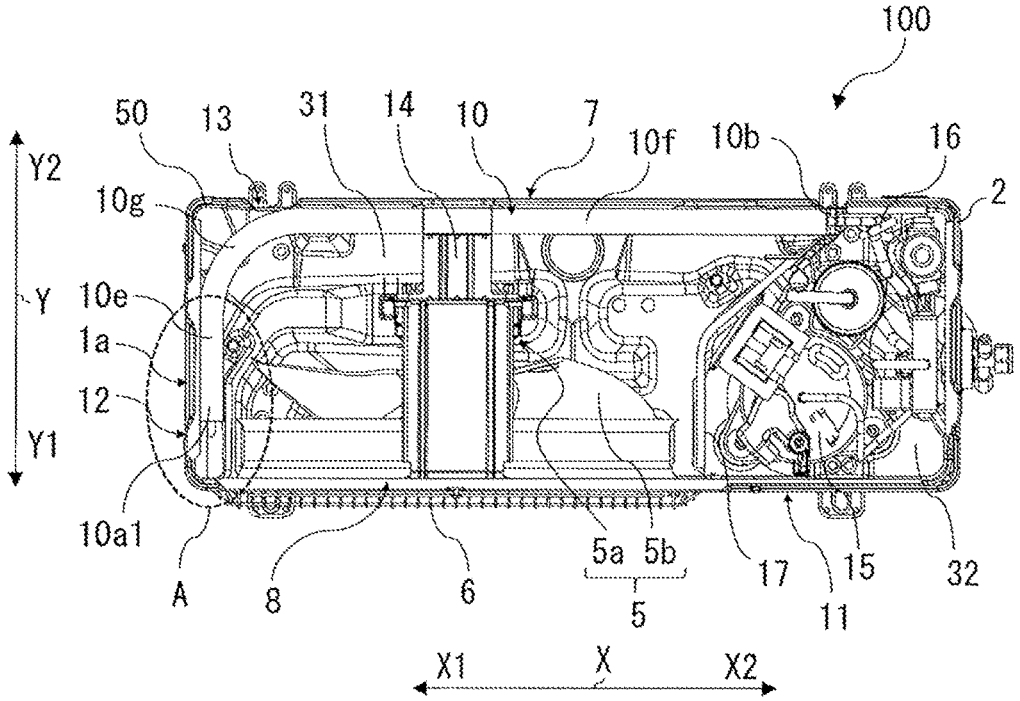
FIG. 5 is a top view of the outdoor unit according to Embodiment 1 of the present disclosure with a top panel removed.

FIG. 5 is a top view of the outdoor unit 100 according to Embodiment 1 of the present disclosure with the top panel 3 removed. An internal configuration of the outdoor unit 100 for an air-conditioning apparatus will be described below with reference to FIGS. 3 and 5. The outdoor unit 100 includes the partition 17, the heat exchanger 10, the air-sending device 5, a motor support 14, and a compressor 15 in the casing 50.

The partition 17, which is disposed in the casing 50, is a separating wall that divides a space in the casing 50 of the outdoor unit 100 into the air-sending device chamber 31 and a machine chamber 32. The partition 17 is a plate-shaped part formed by, for example, bending sheet metal. The partition 17 is disposed on the base 4 in the casing 50 such that the partition 17 extends from the base 4 upward (along the Z axis) and also extends in the direction of depth of the base 4 (along the Y axis). An electric equipment box (not illustrated) is attached to the partition 17.

The air-sending device chamber 31 is a space defined by the shell panel 1, the top panel 3, the base 4, and the partition 17. The air-sending device chamber 31 is configured such that outdoor air is suctioned from the outside of the outdoor unit 100 through the air inlets, including the rear opening 7 and the side openings 1*a*, and the air in the outdoor unit 100 is discharged out of the outdoor unit 100 through the air outlet 8. The machine chamber 32 is a space defined by the front portion 11 of the shell panel 1, the side panel 2, the top panel 3, the base 4, and the partition 17, and has a structure that prevents the entry of dust or water from the outside of the outdoor unit 100. The space of the air-sending device chamber 31 in the casing 50 contains the heat exchanger 10 and the air-sending device 5 facing the heat exchanger 10. The space of the machine chamber 32 in the casing 50 contains the compressor 15 and a refrigerant pipe 16. The heat exchanger 10 and the compressor 15 are arranged on the base 4. The refrigerant pipe 16 connects components constituting a refrigeration cycle circuit.

Figure 6:
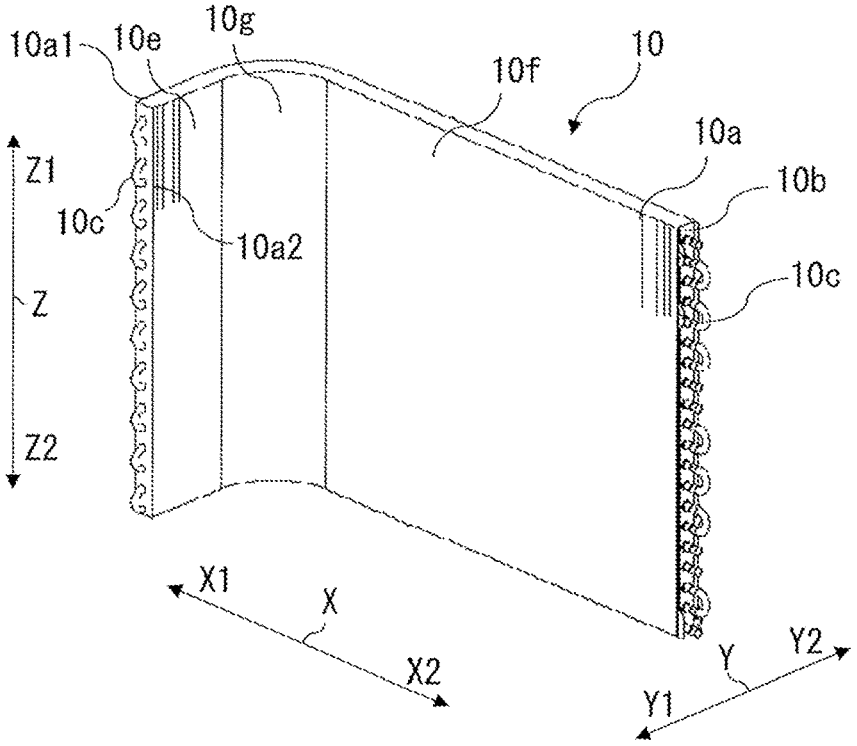
FIG. 6 is a perspective view of a heat exchanger of the outdoor unit according to Embodiment 1 of the present disclosure.

FIG. 6 is a perspective view of the heat exchanger 10 of the outdoor unit 100 according to Embodiment 1 of the present disclosure. The heat exchanger 10 will be described below with reference to FIGS. 5 and 6. The heat exchanger 10, which exchanges heat between refrigerant flowing through the heat exchanger 10 and outdoor air, is used as an evaporator in a heating operation and is used as a condenser in a cooling operation. The heat exchanger 10 has a side area 10*e*, a rear area 10*f*, and a curved area 10*g*, and has an L-shape defined by the side area 10*e*, the rear area 10*f*, and the curved area 10*g* when the heat exchanger 10 is viewed in a direction perpendicular to the base 4. Such an L-shaped bent structure enables the heat exchanger 10 to have a greater number of fins 10*a* than does an I-shaped heat exchanger 10A, which will be described later, and a greater amount of heat exchange than does the I-shaped heat exchanger 10A.

The heat exchanger 10 is disposed between the casing 50 and the air-sending device 5. As illustrated in FIG. 5, the rear area 10*f* of the heat exchanger 10 faces the rear opening 7 in the outdoor unit 100. The rear area 10*f* is exposed to the outside through the rear opening 7. As illustrated in FIG. 5, the side area 10*e* of the heat exchanger 10 faces the side openings 1*a* in the outdoor unit 100. The side area 10*e* is exposed to the outside through the side openings 1*a*. In other words, the heat exchanger 10 is disposed to be exposed through the air inlets. Although FIGS. 5 and 6 illustrate the heat exchanger 10 having an L-shape, the heat exchanger 10 may be U-shaped, when the heat exchanger 10 is viewed in the direction perpendicular to the base 4, such that the curved area 10*g* and the side area 10*e* are arranged at each end of the heat exchanger.

The heat exchanger 10, which is, for example, a fin-and-tube heat exchanger, includes heat transfer tubes 10*c* through which the refrigerant passes and fins 10*a* by which to increase the area of heat transfer between the outdoor air and the refrigerant flowing through the heat transfer tubes 10*c*. The heat transfer tubes 10*c* extend through the fins 10*a*. The refrigerant passes through the heat transfer tubes 10*c*. The refrigerant passing through the heat transfer tubes 10*c* rejects heat or receives heat, thus achieving the cooling operation or the heating operation of an air-conditioning apparatus.

In the heat exchanger 10, the fins 10*a*, which are strip-shaped, spaced apart from each other are horizontally arranged at right angles to the rear opening 7 and the side openings 1*a*. A fastening plate 10*b* is disposed at the end of the heat exchanger 10 closest to the machine chamber 32 in the direction in which the fins 10*a* are arranged. The fastening plate 10*b* is secured to the partition 17 and the side panel 2 with bolts to attach the heat exchanger 10 to the inside of the outdoor unit 100. The fins 10*a* include an end fin group 10*a*1 located at the end remote from the partition 17. The end fin group 10*a*1 is composed of fins 10*a* arranged at the end remote from the partition 17. In addition, the end fin group 10*a*1 includes an outermost fin 10*a*2 located at the extremity remote from the partition 17.

The air-sending device 5, which is disposed in the casing 50, creates a flow of air passing through the side openings 1*a*, the rear opening 7, and the casing 50. As illustrated in FIG. 5, the air-sending device 5 is an air-sending means including a motor 5*a* and the propeller fan 5*b*, and produces air circulation for efficient heat exchange at the heat exchanger 10. With reference to FIG. 5, the air-sending device 5 is disposed in front of the heat exchanger 10 (in the Y1 direction) in the casing 50. The air-sending device 5 is fixed by attaching the motor 5*a* to the motor support 14. The air-sending device 5 creates a negative pressure between the heat exchanger 10 and the propeller fan 5*b* to introduce outdoor air into the casing 50 from the rear (located farthest in the Y2 direction) of the casing 50 and discharge the outdoor air, introduced into the outdoor unit 100, to the outside of the casing 50 from the front (located farthest in the Y1 direction) of the outdoor unit 100. Furthermore, the air-sending device 5 creates a negative pressure between the heat exchanger 10 and the propeller fan 5*b* to introduce outdoor air into the casing 50 from the side (located farthest in the X1 direction) of the casing 50 and discharge the outdoor air, introduced into the outdoor unit 100, to the outside of the casing 50 from the front (located farthest in the Y1 direction) of the outdoor unit 100.

The motor support 14 is a pillar-shaped part extending between the base 4 and the top panel 3 in the direction of height (along the Z axis) in the casing 50. The motor 5*a* of the air-sending device 5 is secured to and held at substantially the middle of the motor support 14 in the direction of height (along the Z axis). The motor support 14 is secured to the base 4 with fasteners, such as screws.

The compressor 15 is a device that suctions low temperature and low pressure refrigerant, compresses the suctioned refrigerant into high temperature and high pressure refrigerant, and then discharges the refrigerant. The compressor 15 is, for example, a rotary compressor, a scroll compressor, or a vane compressor. The compressor 15 may be, for example, a compressor including an inverter configured to control a capacity.

(Details of Side Portion 12 and Vent 1*c*)

Figure 7:
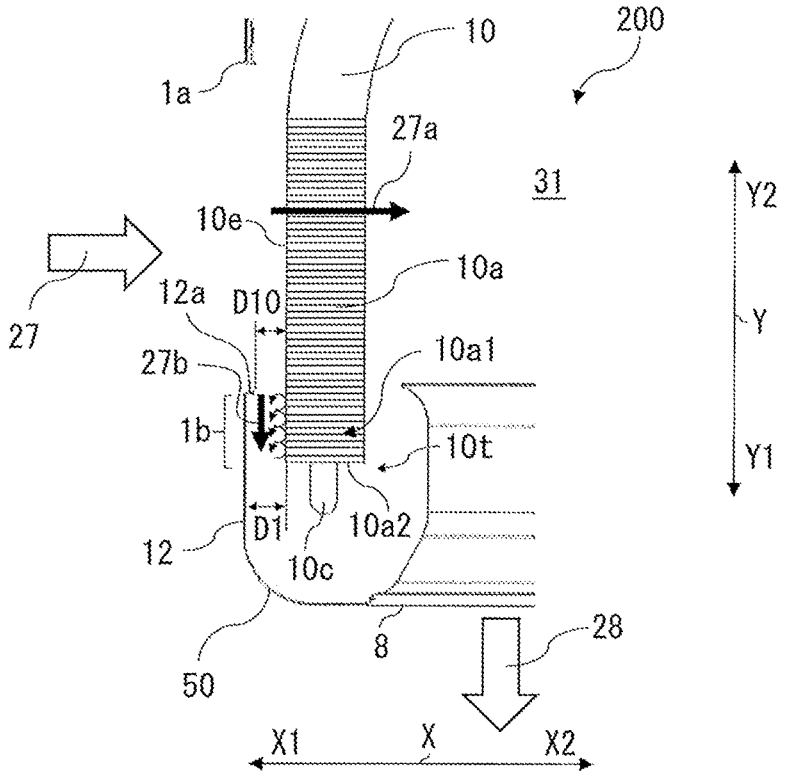
FIG. 7 is a top schematic diagram illustrating an end of a heat exchanger disposed in an outdoor unit according to Comparative Example.
Figure 8:
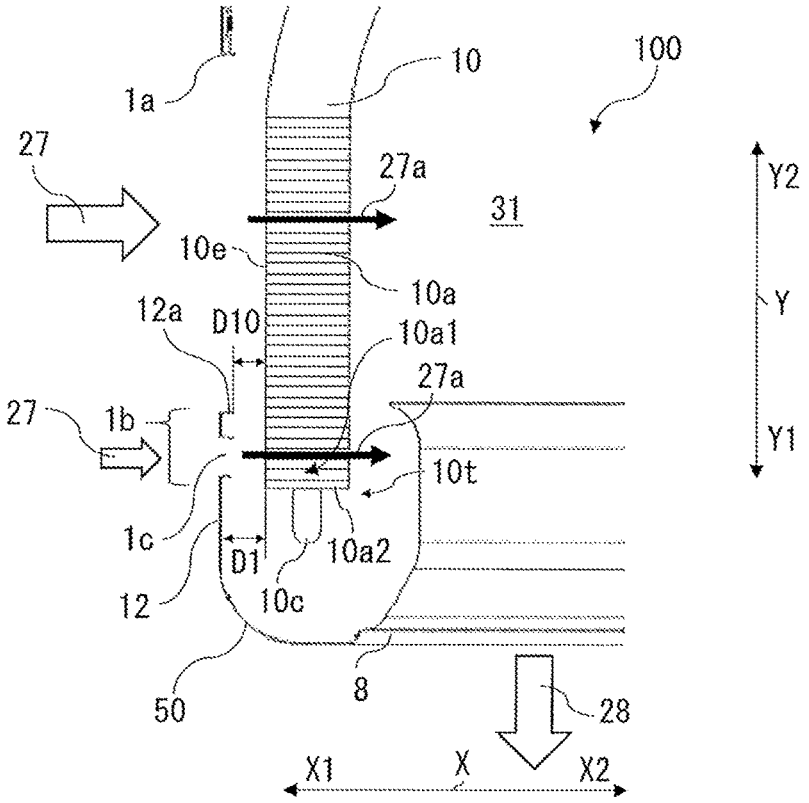
FIG. 8 is a top schematic diagram illustrating an end of the heat exchanger disposed in the outdoor unit according to Embodiment 1 of the present disclosure.

FIG. 7 is a top schematic diagram illustrating an end 10*t* of a heat exchanger 10 disposed in an outdoor unit 200 according to Comparative Example. FIG. 8 is a top schematic diagram illustrating an end 10*t* of the heat exchanger 10 disposed in the outdoor unit 100 according to Embodiment 1 of the present disclosure. FIGS. 7 and 8 are enlarged views of part A in FIG. 5. A commonality between the configuration of the outdoor unit 200 according to Comparative Example and the configuration of the outdoor unit 100 according to Embodiment 1 of the present disclosure and a difference between the configuration of the outdoor unit 200 and the configuration of the outdoor unit 100 will be described with reference to FIGS. 7 and 8. The end 10*t* of the heat exchanger 10 is the end remote from the machine chamber 32 in the direction in which the fins 10*a* are arranged. In other words, the end 10*t* of the heat exchanger 10 is located closer to the side portion 12 than is the opposite end.

The commonality between the configurations of the outdoor units 100 and 200 will be described below. For the sake of assembly, or to avoid, for example, interference between parts during assembly of the outdoor unit 100 and the outdoor unit 200, the heat exchanger 10 is disposed at a distance from a shell part, for example, the side portion 12. As described above, the side portion 12 has the side openings 1*a*. With reference to FIGS. 7 and 8, the side edge parts 12*a*, defining edges of the side openings 1*a*, of the side portion 12 are bent toward the side area 10*e* of the heat exchanger 10 to reduce a gap between the side portion 12 and the side area 10*e* of the heat exchanger 10. Specifically, the side portion 12 is located at a distance D1 from the side area 10*e*, whereas each side edge part 12*a* is located at a distance D10 smaller than the distance D1 from the side area 10*e* (D1>D10). The side edge part 12*a* is formed by bending an edge part of the side portion 12 such that the distance D10 ranges from, for example, 5 to 10 mm. The side edge part 12*a* is formed by burring, for example.

As described above, the outdoor units 100 and 200 are configured such that each side edge part 12*a*, defining an edge of the side opening 1*a*, of the side portion 12 is bent toward the fins 10*a* to reduce the gap between the side edge part 12*a* and the heat exchanger 10. Such a configuration of the outdoor units 100 and 200 prevents the entry of, for example, a finger into the gap between the side edge part 12*a* and the heat exchanger 10, thus ensuring safety. Furthermore, the outdoor units 100 and 200 are formed such that the side edge part 12*a* is bent inward not to protrude outward. Such a configuration eliminates the need for covering, for example, a burr of the side edge part 12*a* with resin or any other material, and ensures safety. Although the side edge part 12*a* bent in an L-shape is illustrated as an example, the side edge part 12*a* may be folded in contact with the side portion 12. Furthermore, the side edge part 12*a* may be curved in a U-shape such that its folded portion is not in contact with the side portion 12. Additionally, the shape of the side edge part 12*a* is not limited to a bent shape. The side edge part 12*a* may have a shape with no bent portion. In this case, as the side edge part 12*a* includes no bent portion, the distance D1 provided between the side portion 12 and the side area 10*e* is made smaller than that in the configuration in which the side edge part 12*a* is bent in consideration of, for example, the above-described safety.

The difference between the configurations of the outdoor units 100 and 200 will be described below. The outdoor unit 100 differs from the outdoor unit 200 in that the side portion 12 has the vent 1*c* located between the side openings 1*a* and the front portion 11. The side portion 12, included in the casing 50, of the outdoor unit 100 has the vent 1*c* facing the end fin group 10*a*1. As illustrated in FIG. 4, the side portion 12 has at least one vent 1*c* located along the side edge parts 12*a*, which define edges of the side openings 1*a*.

The vent 1*c* is located between the side edge parts 12*a* and the front portion 11. Furthermore, the vent 1*c* is located in an overlapping region 1*b* of the side portion 12 in which the side portion 12 overlaps the side area 10*e* of the heat exchanger 10 in a direction perpendicular to the side portion 12. More specifically, the side portion 12 has the overlapping region 1*b*, which is a wall part located between the side edge parts 12*a* and the outermost fin 10*a*2 when the side portion 12 is viewed in the direction perpendicular to the side portion 12. At least part of the vent 1*c* is located in the overlapping region 1*b*. The overlapping region 1*b* of the side portion 12 is a part of the side portion 12 that faces the end fin group 10*a*1, which define the side area 10*e* of the heat exchanger 10. Although the whole of the vent 1*c* may be located in the overlapping region 1*b*, it is preferred that part of the vent 1*c* be located in the overlapping region 1*b*. In other words, the vent 1*c* is preferably formed such that the outermost fin 10*a* is located in the vent 1*c* when the vent 1*c* is viewed in the direction perpendicular to the side portion 12.

The vent 1*c* is a through-hole in the side portion 12. As illustrated in FIG. 4, the vent 1*c* has an oblong shape. It is only required that the vent 1*c* is a through-hole. For example, the vent 1*c* may have any other shape, such as a circular shape, an elliptical shape, an oval shape, an obround shape, a corner-rounded rectangular shape, a rectangular shape, and a polygonal shape. The number of vents 1*c* in the side portion 12 may be one or more. The diameter and area of the vent 1*c* or the number of vents 1*c* is determined in relation to the distance between the side portion 12 and the fins 10*a*, and is a matter of design choice. The vent 1*c* is an air inlet of the casing 50 through which air is caused to enter the casing 50 from the outside by actuating the air-sending device 5.

[Operation of Outdoor Unit 100]

A common operation of the outdoor unit 100 according to Embodiment 1 of the present disclosure and the outdoor unit 200 according to Comparative Example will be described below. For each of the outdoor units 100 and 200, while the outdoor unit is being driven, the air-sending device 5 is driven to increase the efficiency of heat exchange between the refrigerant flowing through the heat exchanger 10 and outdoor air. The air-sending device 5 creates a negative pressure between the heat exchanger 10 and the propeller fan 5*b* to introduce outdoor air 27 into the casing 50 from the rear and the side of the casing 50. Then, the air-sending device 5 causes the air introduced into the casing 50 and subjected to heat exchange to be discharged, as blown air 28, out of the casing 50 through the air outlet 8 located in the front (located farthest in the Y1 direction) of the casing 50. At this time, suction air 27*a* enters the casing 50 of each of the outdoor units 100 and 200 through the rear opening 7 and the side openings 1*a*. The suction air 27*a* entering the casing 50 flows through the spaces between the fins 10*a* of the heat exchanger 10 and exchanges heat with the refrigerant flowing through the inside of the heat transfer tubes 10*c*.

An operation of the outdoor unit 200 according to Comparative Example will be described below with reference to FIG. 7. Suction air 27*b*, which is part of the outdoor air 27 entering through the air inlets, such as the side openings 1*a*, enters the gap between the side edge parts 12*a* and the side area 10*e* of the heat exchanger 10 without passing through the spaces between the fins 10*a*. The suction air 27*b* entering the gap between the side edge parts 12*a* and the side area 10*e* passes through a space between the side portion 12 and the side area 10*e* in the direction in which the fins 10*a* are arranged. At this time, the flow of the suction air 27*b* in the direction in which the fins 10*a* are arranged causes turbulence of the air or vortices of air at the edges of the fins 10*a*, generating noise, such as a high-pitched sound like a peep.

At the end fin group 10*a*1 facing the overlapping region 1*b* in the outdoor unit 200, the suction air 27*b* flows in the direction in which the fins 10*a* are arranged and then flows around the outermost fin 10*a*2. This flow makes it difficult for the suction air 27*a* to flow through the spaces between the fins 10*a* at the end 10*t* of the heat exchanger 10. The outdoor unit 200 may fail to fully demonstrate its heat exchange capacity at the end 10*t*.

In contrast, the outdoor unit 100 according to Embodiment 1 of the present disclosure has the vent 1*c* in the overlapping region 1*b* of the side portion 12. The vent 1*c* also allows the suction air 27*a* to enter the casing 50 through the vent 1*c*. As described above, in the case where the side portion 12 has no vent 1*c*, the suction air 27*b* entering the gap between the side edge parts 12*a* and the side area 10*e* passes through the space between the side portion 12 and the side area 10*e*, causing noise. In the outdoor unit 100, the vent 1*c* of the side portion 12 allows the suction air 27*a* to flow in a direction perpendicular to the direction in which the fins 10*a* are arranged. Therefore, the suction air 27*a* flows straight through the spaces between the fins 10*a*, which define the side area 10*e*, and thus readily passes through the heat exchanger 10 with a low air flow resistance. Thus, the suction air 27*a* passing through the vent 1*c* is less likely to cause turbulence of the air or vortices of air, and thus causes no air-induced noise in the outdoor unit 100.

As the suction air 27*a* flows straight through the spaces between the fins 10*a*, which define the side area 10*e*, with a low air flow resistance, the outdoor air 27 is less likely to enter the gap, where the air flow resistance is high, between the side edge parts 12*a* and the side area 10*e*. Thus, the suction air 27*b* is less likely to flow through the gap between the side edge parts 12*a* and the side area 10*e*, eliminating air-induced noise in the outdoor unit 100. Furthermore, even if the outdoor air 27 enters the gap between the side edge parts 12*a* and the side area 10*e*, the flow of the suction air 27*b* in the direction in which the fins 10*a* are arranged will be interrupted by the suction air 27*a* flowing straight with a low air flow resistance. Therefore, the suction air 27*b* is less likely to flow through the gap between the side edge parts 12*a* and the side area 10*e*, thus eliminating air-induced noise in the outdoor unit 100. Even if the suction air 27*b* passing past the side edge parts 12*a* causes a vortex of air, the vortex will be canceled by the suction air 27*a* passing through the vent 1*c* and flowing straight.

In the above-described outdoor unit 200, as the suction air 27*b* entering the gap between the side edge parts 12*a* and the side area 10*e* passes through the space between the side portion 12 and the side area 10*e* in the direction in which the fins 10*a* are arranged, the suction air 27*b* hardly passes through the spaces between the fins 10*a* of the heat exchanger 10. In the outdoor unit 100, however, the suction air 27*a* flows straight through the spaces between the fins 10*a*, which define the side area 10*e*, and thus readily passes through the heat exchanger 10 with a low air flow resistance.

Therefore, the outdoor unit 100 demonstrates higher heat exchange capacity at the end 10*t* of the heat exchanger 10 than does the outdoor unit 200 according to Comparative Example.

Figure 9:
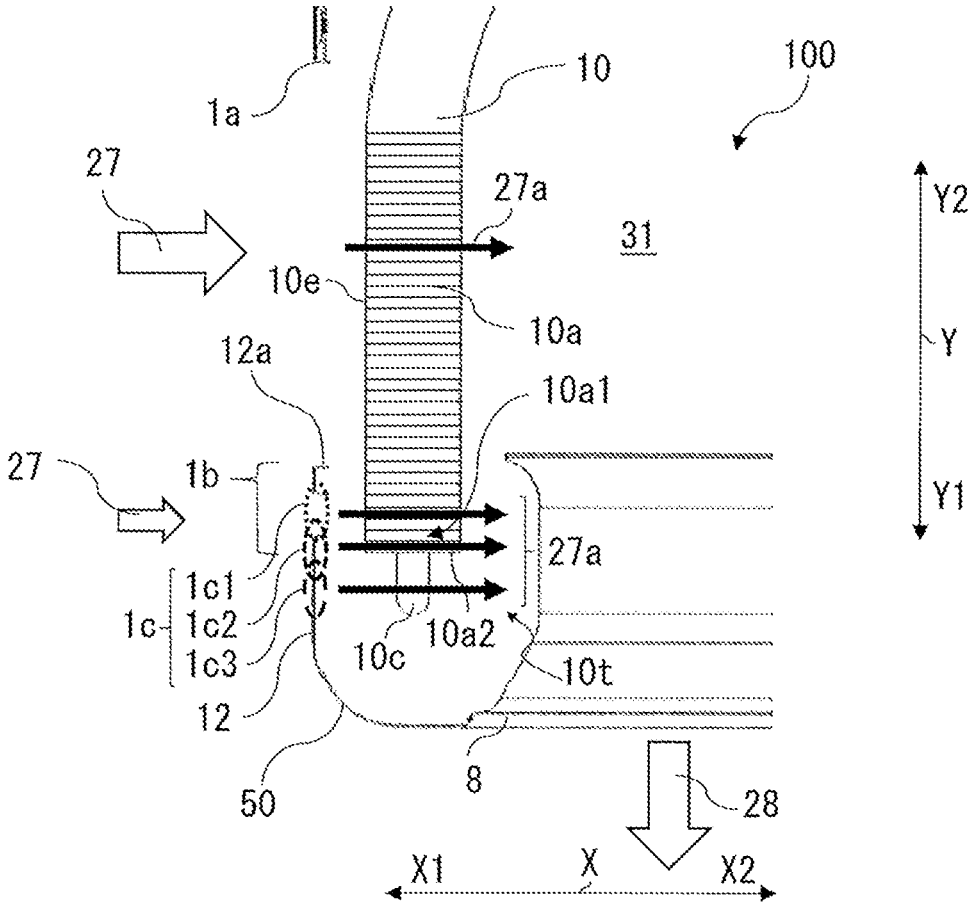
FIG. 9 is a top schematic diagram illustrating the end of the heat exchanger and explaining the position of a vent in FIG. 8.
Figure 10:
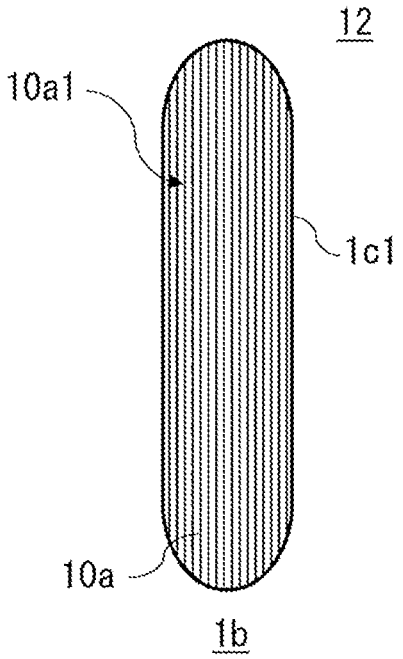
FIG. 10 is a schematic diagram of a vent in FIG. 9.
Figure 11:
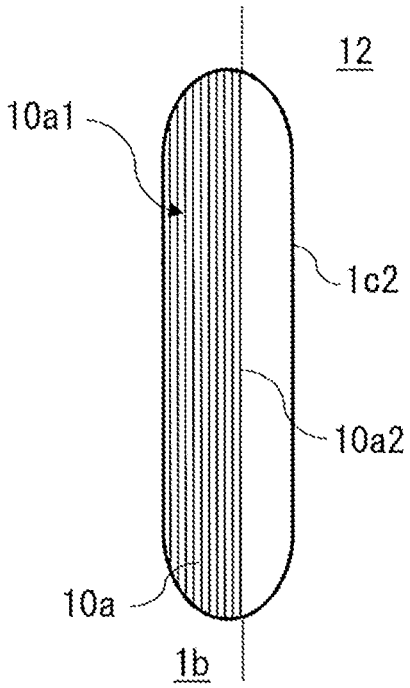
FIG. 11 is a schematic diagram of another vent in FIG. 9.

FIG. 9 is a top schematic diagram illustrating the end 10*t* of the heat exchanger 10 and explaining the position of the vent 1*c* in FIG. 8. FIG. 10 is a schematic diagram of a vent 1*c*1 in FIG. 9. FIG. 11 is a schematic diagram of another vent 1*c*2 in FIG. 9. A desired position of the vent 1*c* in the side portion 12 will be described below with reference to FIGS. 9 to 11. For the position of the vent 1*c* in the side portion 12, three positions of the vent 1*c*1, the vent 1*c*2, and a vent 1*c*3 are conceivable.

The vent 1*c*1 is a through-hole that is fully located in the overlapping region 1*b*. Therefore, the whole of a space defined by an inner edge of the vent 1*c*1 faces the side area 10*e* of the heat exchanger 10. In other words, as illustrated in FIG. 10, only the fins 10*a* are arranged in the vent 1*c*1 when the vent 1*c*1 is viewed in the direction perpendicular to the side portion 12. Therefore, the suction air 27*a* passing through the vent 1*c*1 passes through the side area 10*e* of the heat exchanger 10. As a result, the outdoor unit 100 having the vent 1*c*1 reduces or eliminates air-induced noise and demonstrates higher heat exchange capacity at the end 10*t* of the heat exchanger 10 than does the outdoor unit 200 according to Comparative Example.

Furthermore, the amount of suction air 27*a* that passes through the heat exchanger 10 in the outdoor unit 100 having the vent 1*c*1 is greater than that in the outdoor unit 100 having the vent 1*c*2. Therefore, the outdoor unit 100 having the vent 1*c*1 demonstrates higher heat exchange capacity at the end 10*t* of the heat exchanger 10 than does the outdoor unit 100 having the vent 1*c*2.

The vent 1*c*2 is a through-hole that has at least part that overlaps the overlapping region 1*b*. Therefore, part of a space defined by an inner edge of the vent 1*c*2 faces the side area 10*e* of the heat exchanger 10. In other words, as illustrated in FIG. 11, the outermost fin 10*a*2 is located in the vent 1*c*2 when the vent 1*c*2 is viewed in the direction perpendicular to the side portion 12. Therefore, the suction air 27*a* passing through the vent 1*c*2 partly passes through the side area 10*e* of the heat exchanger 10, and partly flows into the air-sending device chamber 31 without passing through the side area 10*e* of the heat exchanger 10. As a result, the vent 1*c*2 reduces or eliminates air-induced noise and allows the heat exchange capacity at the end 10*t* of the heat exchanger 10 to be higher than that in the outdoor unit 200 according to Comparative Example.

Furthermore, the amount of suction air 27*a* that does not pass through the heat exchanger 10 in the outdoor unit 100 having the vent 1*c*2 is greater than that in the outdoor unit 100 having the vent 1*c*1. Therefore, the amount of suction air 27*a* passing through the vent 1*c*2 is greater than that of suction air 27*a* passing through the vent 1*c*1. Thus, suction air 27*b* is less likely to flow through the gap between the side edge parts 12*a* and the side area 10*e* in the outdoor unit 100 having the vent 1*c*2 than does that in the outdoor unit 100 having the vent 1*c*1, further reducing the likelihood that the outdoor unit 100 having the vent 1*c*2 will generate air-induced noise. The ratio of the area of part of the vent 1*c*2 that is located in the overlapping region 1*b* to the area of part of the vent 1*c*2 that is not located in the overlapping region 1*b* is determined in relation to the gap between the side portion 12 and the fins 10*a*, and is a matter of design choice.

The vent 1*c*3 is located in a region other than the overlapping region 1*b* and between the side edge parts 12*a* and the front portion 11 in the direction of depth of the outdoor unit 100 (along the Y axis). Therefore, the whole of a space defined by an inner edge of the vent 1*c*3 does not face the fins 10*a*, which define the side area 10*e* of the heat exchanger 10. Thus, the suction air 27*a* passing through the vent 1*c*3 flows into the air-sending device chamber 31 without passing through the spaces between the fins 10*a*, which define the side area 10*e* of the heat exchanger 10.

The amount of suction air 27*a* that does not pass through the heat exchanger 10 in the outdoor unit 100 having the vent 1*c*3 is greater than that in the outdoor unit 100 having the vent 1*c*1 or 1*c*2. Therefore, the amount of suction air 27*a* passing through the vent 1*c*3 is greater than that of suction air 27*a* passing through the vent 1*c*1 or 1*c*2. Thus, suction air 27*b* hardly flows through the gap between the side edge parts 12*a* and the side area 10*e* even in the outdoor unit 100 having the vent 1*c*3, so that air may hardly induce noise.

At the position of the vent 1*c*3, the side area 10*e* of the heat exchanger 10, which is a resistor to the flow of air, does not exist in the direction in which the suction air 27*a* flows. Therefore, the suction air 27*a* enters the casing 50 more readily than does that in the outdoor unit 100 having the vent 1*c*1 and than does that in the outdoor unit 100 having the vent 1*c*2. For the position of the vent 1*c*3, however, the suction air 27*a* passing through the vent 1*c*3 does not pass through the heat exchanger 10, resulting in a reduction in heat exchange capacity of the heat exchanger 10. From the viewpoint of the heat exchange capacity of the heat exchanger 10, therefore, the vent 1*c* of the outdoor unit 100 is more preferably located at the position of the vent 1*c*1 or the vent 1*c*2 than at the position of the vent 1*c*3.

[Advantageous Effects of Outdoor Unit 100]

In the outdoor unit 100, suction air 27*a* entering through the vent 1*c* flows straight through the spaces between the fins 10*a*. This flow causes suction air 27*a* entering the casing 50 through the side openings 1*a*, used as air inlets, to hardly enter the gap, which has a higher air flow resistance than does the vent 1*c*, between the side edge parts 12*a* of these air inlets and the fins 10*a*. As a result, suction air 27*b* is kept from flowing through a gap between the casing 50 and the heat exchanger 10 in the direction in which the fins 10*a* are arranged, thus reducing or eliminating turbulence of the air or vortices of air. Thus, the outdoor unit 100 does not generate noise induced by air that enters the casing 50 through the side openings 1*a*. Even if suction air 27*a* enters the gap between the side edge parts 12*a* and the fins 10*a*, suction air 27*b* flowing in the direction in which the fins 10*a* are arranged will be interrupted by suction air 27*a* passing through the vent 1*c* and flowing straight. As a result, the suction air 27*b* is kept from flowing through the gap between the casing 50 and the heat exchanger 10 in the direction in which the fins 10*a* are arranged, thus reducing or eliminating turbulence of the air or vortices of air. Thus, the outdoor unit 100 does not generate noise induced by air that enters the casing 50 through the side openings 1*a*. Even if the suction air 27*b* passing past the side edge parts 12*a* causes a vortex of air, the vortex will be canceled by the suction air 27*a* passing through the vent 1*c* and flowing straight. Thus, the outdoor unit 100 does not generate noise induced by air that enters the casing 50 through the side openings 1*a*. Additionally, in the outdoor unit 100, the suction air 27*a* flows straight through the spaces between the fins 10*a*, which define the side area 10*e*, and thus readily passes through the heat exchanger 10. Thus, the outdoor unit 100 demonstrates higher heat exchange capacity at the end 10*t* of the heat exchanger 10 than does the outdoor unit 200 according to Comparative Example.

For the vent 1*c*2, at least part of this hole is located in the overlapping region 1*b*. In other words, the outermost fin 10*a*2 is located in the vent 1*c*2 when the vent 1*c*2 is viewed in the direction perpendicular to the side portion 12. Therefore, suction air 27*a* passing through the vent 1*c*2 partly passes through the end fin group 10*a*1 of the heat exchanger 10, and partly flows into the air-sending device chamber 31 without passing through the spaces between the fins 10*a* of the heat exchanger 10. As a result, the vent 1*c*2 reduces or eliminates air-induced noise and allows the heat exchange capacity at the end 10*t* of the heat exchanger 10 to be higher than that in the outdoor unit 200 according to Comparative Example.

When the vent 1*c*1 is viewed in the direction perpendicular to the side portion 12, only the fins 10*a* are arranged in this vent. Therefore, suction air 27*a* passing through the vent 1*c*1 readily passes through the spaces between the fins 10*a* at the end 10*t* of the heat exchanger 10, whereas the suction air 27*a* hardly flows through the spaces between the fins 10*a* at the end 10*t* of the heat exchanger 10 in the outdoor unit 200 according to Comparative Example. As a result, the outdoor unit 100 having the vent 1*c*1 reduces or eliminates air-induced noise and demonstrates higher heat exchange capacity at the end 10*t* of the heat exchanger 10 than does the outdoor unit 200 according to Comparative Example.

The side portion 12 having the vent 1*c* constitutes a side wall of the air-sending device chamber 31 that is opposite the partition 17. Such a configuration enables suction air 27*a* entering the outdoor unit 100 through the vent 1*c* to pass straight through the spaces between the fins 10*a* at the end 10*t* of the L-shaped heat exchanger 10. Thus, the outdoor unit 100 including the L-shaped heat exchanger 10 has a greater amount of heat exchange than does that including the I-shaped heat exchanger 10A as well as reducing or eliminating air-induced noise.

The multiple side openings 1*a*, used as air inlets, are arranged vertically in the side portion 12. At least one vent 1*c* is located along the side edge parts 12*a* of the multiple side openings 1*a*. This arrangement allows suction air 27*a* entering the outdoor unit 100 through the vent 1*c* to pass straight through the spaces between the fins 10*a* at the end 10*t* of the L-shaped heat exchanger 10. Thus, the outdoor unit 100 including the L-shaped heat exchanger 10 has a greater amount of heat exchange than does that including the I-shaped heat exchanger 10A as well as reducing or eliminating air-induced noise.

The vent 1*c* has a circular, corner-rounded rectangular, or oblong shape. In the outdoor unit 100, therefore, the side edge parts 12*a* adjacent to the vent 1*c* is hardly under localized high stress, thus enhancing the strength of the casing 50.

Embodiment 2

[Configuration of Outdoor Unit 300]

Figure 12:
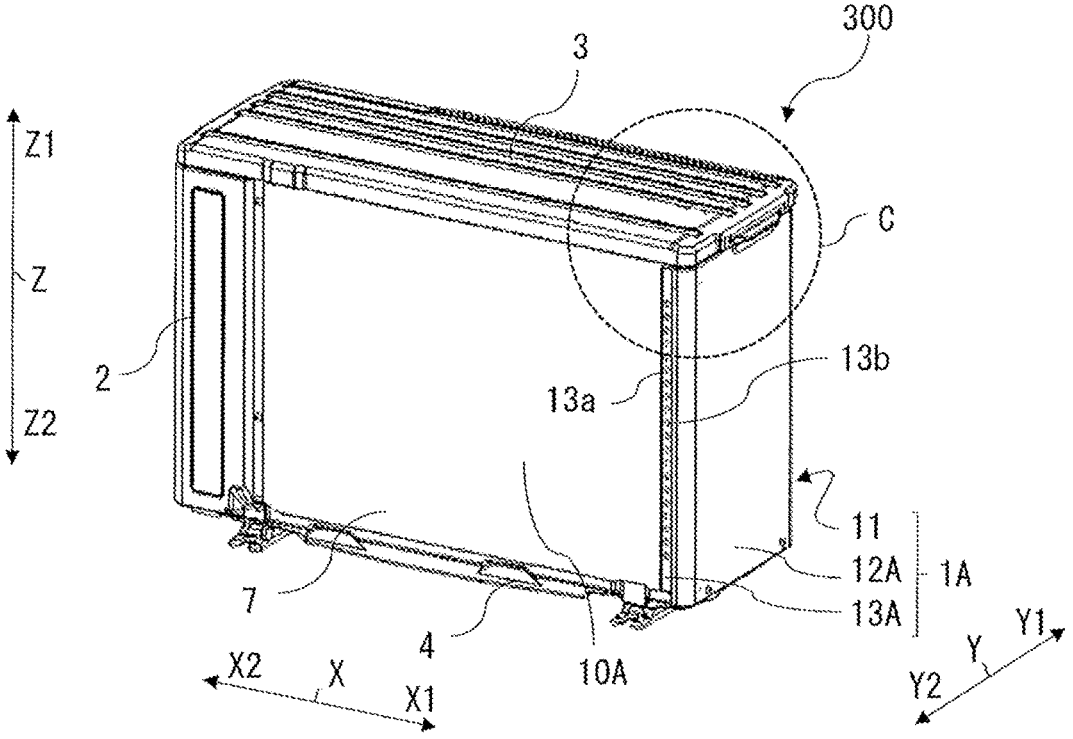
FIG. 12 is a rear perspective view of an outdoor unit according to Embodiment 2 of the present disclosure.
Figure 13:
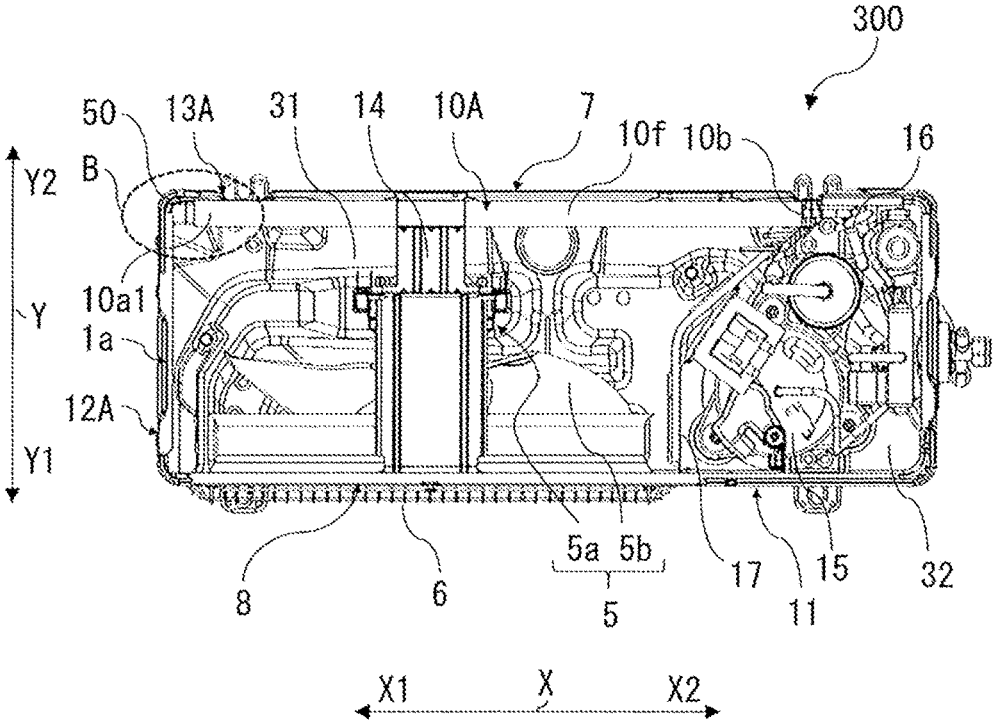
FIG. 13 is a top view of the outdoor unit according to Embodiment 2 of the present disclosure with a top panel removed.

FIG. 12 is a rear perspective view of the outdoor unit 300 according to Embodiment 2 of the present disclosure. FIG. 13 is a top view of the outdoor unit 300 according to Embodiment 2 of the present disclosure with a top panel 3 removed. The same parts and components as those in the outdoor unit 100 in FIGS. 1 to 9 are designated by the same reference signs and a description of these parts and components is omitted. The outdoor unit 300 according to Embodiment 2 of the present disclosure differs from the outdoor unit 100 according to Embodiment 1 in the configuration of the shell panel 1 and that of the heat exchanger 10. In the following description about the outdoor unit 300, the orientation of the outdoor unit 300 is the same as that of the above-described outdoor unit 100, and the X, Y, and Z axes of the outdoor unit 300 are the same as those of the above-described outdoor unit 100. The following description will focus on the difference between the outdoor unit 300 and the outdoor unit 100.

(Shell of Outdoor Unit 300)

As illustrated in FIGS. 12 and 13, the outdoor unit 300 includes a casing 50 having a substantially rectangular cuboid shape. The casing 50 of the outdoor unit 300 is made of sheet metal and constitutes a shell of the outdoor unit 300. The casing 50 of the outdoor unit 300 includes a shell panel 1A, a side panel 2, the top panel 3, and a base 4. Each of the shell panel 1A and the side panel 2 includes a flange at its top. The top panel 3 is attached to the flanges. Similarly, the base 4 also includes a flange. The shell panel 1A and the side panel 2 are secured to the flange with, for example, bolts, so that the shell panel 1A and the side panel 2 are placed on and combined with the base 4.

The shell panel 1A is a sheet metal panel. The shell panel 1A includes a front portion 11, a side portion 12A, and a rear portion 13A, which are integrated in one piece. The shell panel 1A is bent to have an L-shape defined by the front portion 11, which is horizontally long, and the side portion 12A, which is vertically long, when the shell panel 1A is viewed from above the outdoor unit 300, that is, toward the position where the top panel 3 is disposed. Although the front portion 11 and the side portion 12A of the shell panel 1A are integrated in one piece, the shell panel 1A may have any other form. The shell panel 1A may be composed of a plurality of sheet metal panels such that the front portion 11 and the side portion 12A are separate panels.

The side portion 12A constitutes a wall extending in the direction of depth of the casing 50 (along the Y axis). Although the outdoor unit 100 according to Embodiment 1 has the side openings 1*a* and the vent 1*c*, the outdoor unit 300 according to Embodiment 2 of the present disclosure has no side openings 1*a* and no vent 1*c*. The reason why the side portion 12A has no side openings 1*a* and no vent 1*c* is that the heat exchanger 10A mounted in the outdoor unit 300 is I-shaped when the heat exchanger 10A is viewed from above and has no side area 10*e* and eliminates the need for heat exchange with air that enters the outdoor unit through the side openings 1*a*. Although the side portion 12A is illustrated as being flat in FIG. 12, the side portion 12A may be uneven for a variety of reasons, including enhancing the strength of the casing 50, providing the ease of holding the casing 50 to an operator, and rectifying the flow of air through the casing 50.

The rear portion 13A constitutes a part of the rear of the casing 50 and partly covers the rear of the heat exchanger 10A. The rear portion 13A faces a part of the front portion 11 in the direction of depth of the casing 50 (along the Y axis). The shell panel 1A includes the front portion 11, the side portion 12A, and the rear portion 13A, which are integrated in one piece. The shell panel 1 is bent to have an L-shape defined by the side portion 12A and the rear portion 13A when the shell panel 1 is viewed from above the outdoor unit 300, that is, toward the position where the top panel 3 is disposed. The rear portion 13A extends from the side portion 12A to a position where the rear portion 13A partly covers the rear of the heat exchanger 10A. Although the shell panel 1A is bent and the side portion 12A and the rear portion 13A are integrated in one piece, the shell panel 1A may have any other form. The shell panel 1A may be composed of a plurality of sheet metal panels such that the side portion 12A and the rear portion 13A are separate panels.

The rear portion 13A, which constitutes a part of the rear of the casing 50 and partly covers the heat exchanger 10A, defines an edge of a rear opening 7 through which to expose the heat exchanger 10A at the rear of the casing 50. More specifically, the rear opening 7 is defined by respective edges of the rear portion 13A, the top panel 3, the side panel 2, and the base 4. The rear portion 13A has a vent 13*c*. The rear portion 13A having the vent 13*c* is opposite the front portion 11, which is a front wall, having an air outlet 8 in the casing 50, and constitutes a rear wall of an air-sending device chamber 31. The rear portion 13A and the vent 13*c* will be described in detail later.

(Internal Configuration of Outdoor Unit 300)

The outdoor unit 300 includes a partition 17, the heat exchanger 10A, an air-sending device 5, a motor support 14, and a compressor 15 in the casing 50.

Figure 14:
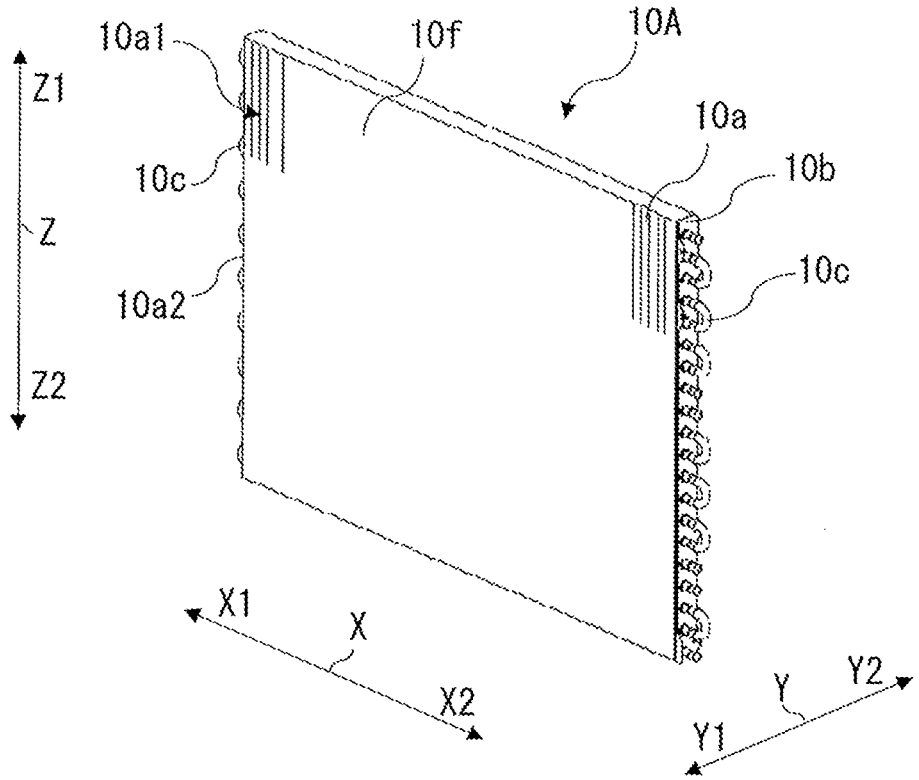
FIG. 14 is a perspective view of a heat exchanger of the outdoor unit according to Embodiment 2 of the present disclosure.

FIG. 14 is a perspective view of the heat exchanger 10A of the outdoor unit 300 according to Embodiment 2 of the present disclosure. The heat exchanger 10A will be described below with reference to FIGS. 13 and 14. The heat exchanger 10A, which exchanges heat between refrigerant flowing through the heat exchanger 10A and outdoor air, is used as an evaporator in the heating operation and is used as a condenser in the cooling operation. The heat exchanger 10A is I-shaped when the heat exchanger 10A is viewed from above in a direction perpendicular to the base 4. In other words, the heat exchanger 10A includes only the rear area 10*f* of the L-shaped heat exchanger 10. As illustrated in FIG. 13, the heat exchanger 10A faces the rear opening 7 in the outdoor unit 300 such that fins 10*a* are exposed to the outside through the rear opening 7.

In the heat exchanger 10A, the fins 10*a*, which are strip-shaped, spaced apart from each other are horizontally arranged at right angles to the rear opening 7. A fastening plate 10*b* is disposed at the end of the heat exchanger 10A closest to a machine chamber 32 in the direction in which the fins 10*a* are arranged. The fastening plate 10*b* is secured to the partition 17 and the side panel 2 with bolts to attach the heat exchanger 10A to the inside of the outdoor unit 300. The fins 10*a* include an end fin group 10*a*1 located at the end remote from the partition 17. The end fin group 10*a*1 is composed of fins 10*a* arranged at the end remote from the partition 17. In addition, the end fin group 10*a*1 includes an outermost fin 10*a*2 located at the extremity remote from the partition 17.

For installation of an air-conditioning apparatus, if the amount of heat exchange of the L-shaped heat exchanger 10 is not needed depending on, for example, the size of a room in which the air-conditioning apparatus is installed, the I-shaped heat exchanger 10A having a reduced number of fins 10*a* may be used. The I-shaped heat exchanger 10A, which has a smaller number of fins 10*a* than does the L-shaped heat exchanger 10, offers advantages in that the cost of parts is lower than that of the L-shaped heat exchanger 10.

(Details of Rear Portion 13A and Vent 13*c*)

Figure 15:
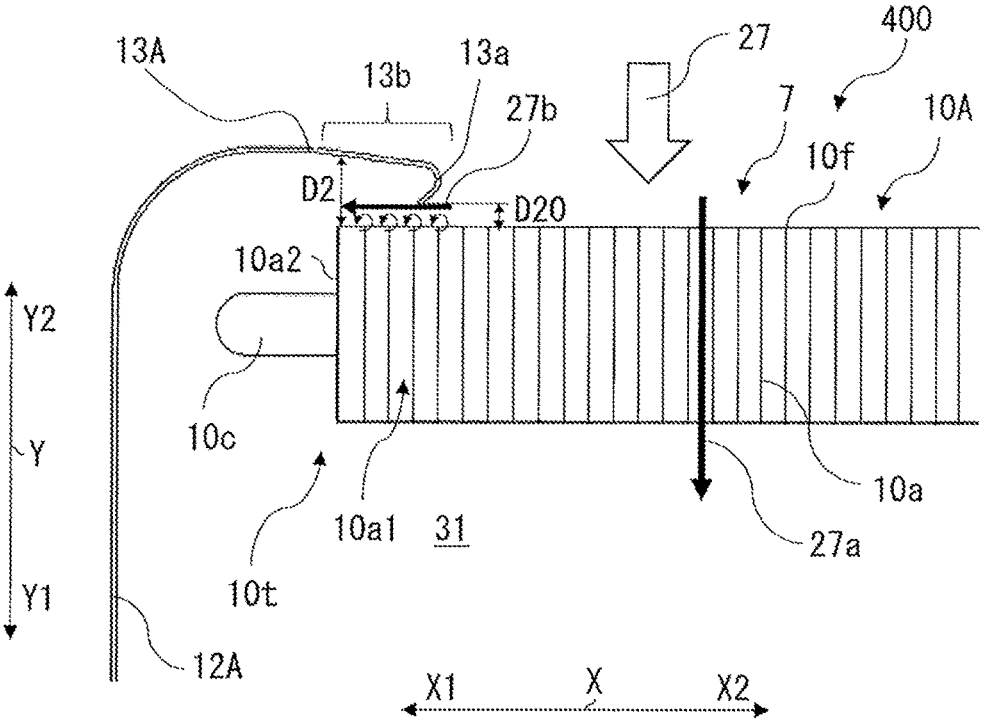
FIG. 15 is a top schematic diagram illustrating an end of a heat exchanger disposed in an outdoor unit according to Comparative Example.
Figure 16:
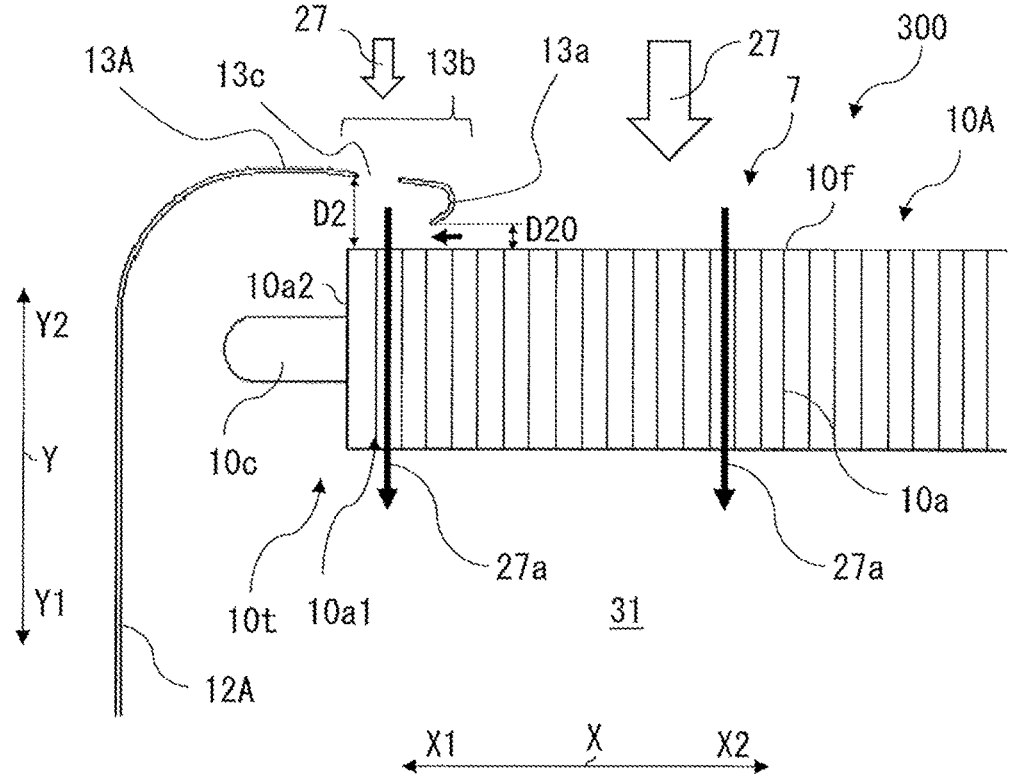
FIG. 16 is a top schematic diagram illustrating an end of the heat exchanger disposed in the outdoor unit according to Embodiment 2 of the present disclosure.

FIG. 15 is a top schematic diagram illustrating an end of a heat exchanger 10A disposed in an outdoor unit 400 according to Comparative Example. FIG. 16 is a top schematic diagram illustrating an end of the heat exchanger 10A disposed in the outdoor unit 300 according to Embodiment 2 of the present disclosure. FIGS. 15 and 16 are enlarged views of part B in FIG. 13. A commonality between the configuration of the outdoor unit 400 according to Comparative Example and the configuration of the outdoor unit 300 according to Embodiment 2 of the present disclosure and a difference between the configuration of the outdoor unit 400 and the configuration of the outdoor unit 300 will be described with reference to FIGS. 15 and 16. An end 10*t* of the heat exchanger 10A is the end remote from the machine chamber 32 in the direction in which the fins 10*a* are arranged. In other words, the end 10*t* of the heat exchanger 10A is located closer to the side portion 12A than is the opposite end adjacent to the machine chamber 32.

The commonality between the configurations of the outdoor units 300 and 400 will be described below. For the sake of assembly, or to avoid, for example, interference between parts during assembly of the outdoor unit 300 and the outdoor unit 400, the heat exchanger 10A is disposed at a distance from a shell part, for example, the rear portion 13A. With reference to FIGS. 15 and 16, the rear portion 13 includes a side edge part 13*a*, which defines an edge of the rear opening 7 and is bent toward the fins 10*a* of the heat exchanger 10A to reduce a gap between the rear portion 13A and the heat exchanger 10A. Specifically, the rear portion 13A is located at a distance D2 from the heat exchanger 10A, whereas the side edge part 13*a* is located at a distance D20 smaller than the distance D2 from the heat exchanger 10A (D2>D20). The side edge part 13*a* is formed by bending an edge part of the rear portion 13A such that the distance D20 ranges from, for example, 5 to 10 mm.

As described above, the outdoor units 300 and 400 are formed such that the side edge part 13*a*, defining an edge of the rear opening 7, of the rear portion 13A is bent toward the heat exchanger 10A to reduce a gap between the side edge part 13*a* and the heat exchanger 10A. Such a configuration of the outdoor units 300 and 400 prevents the entry of a finger into the gap between the side edge part 13*a* and the heat exchanger 10A, thus ensuring safety. Furthermore, the outdoor units 300 and 400 are formed such that the side edge part 13*a* is bent inward not to protrude outward. Such a configuration eliminates the need for covering, for example, a burr of the side edge part 13*a* with resin or any other material, and ensures safety. Although the side edge part 13*a* bent one time is illustrated as an example, the side edge part 13*a* may be folded two times, or with two turns. Alternatively, the side edge part 13*a* may be curved in a U-shape such that its folded portion is not in contact with the rear portion 13A. Additionally, the shape of the side edge part 13*a* is not limited to a bent shape. The side edge part 13*a* may have a shape with no bent portion. In this case, as the side edge part 13*a* includes no bent portion, the distance between the rear portion 13A and the fins 10*a* is made smaller than that in the configuration in which the side edge part 13*a* is bent in consideration of, for example, the above-described safety.

The difference between the configurations of the outdoor units 300 and 400 will be described below. The outdoor unit 300 differs from the outdoor unit 400 in that the rear portion 13A has the vent 13*c* located between the rear opening 7 and the side portion 12A. The rear portion 13A, included in the casing 50, of the outdoor unit 300 has the vent 13*c* facing the end fin group 10*a*1. As illustrated in FIG. 12, the rear portion 13A has at least one vent 13*c* located along the side edge part 13*a* defining an edge of the rear opening 7.

As illustrated in FIG. 16, the vent 13*c* is located between the side edge part 13*a* and the side portion 12A. Furthermore, the vent 13*c* is located in an overlapping region 13*b* of the rear portion 13A in which the rear area 10*f* of the heat exchanger 10A overlaps the rear portion 13A in a direction perpendicular to the rear portion 13A. More specifically, the rear portion 13A has the overlapping region 13*b*, which is a wall part located between the side edge part 13*a* and the outermost fin 10*a*2 when the rear portion 13A is viewed in the direction perpendicular to the rear portion 13A. At least part of the vent 13*c* is located in the overlapping region 13*b*. The overlapping region 13*b* is a part of the rear portion 13A that faces the end fin group 10*a*1, which defines the rear area 10*f* of the heat exchanger 10. Although the whole of the vent 13*c* may be located in the overlapping region 13*b*, it is preferred that part of the vent 13*c* be located in the overlapping region 13*b*. In other words, the vent 13*c* is preferably formed such that the outermost fin 10*a* is located in the vent 13*c* when the vent 13*c* is viewed in the direction perpendicular to the rear area 10*f*.

Figure 17:
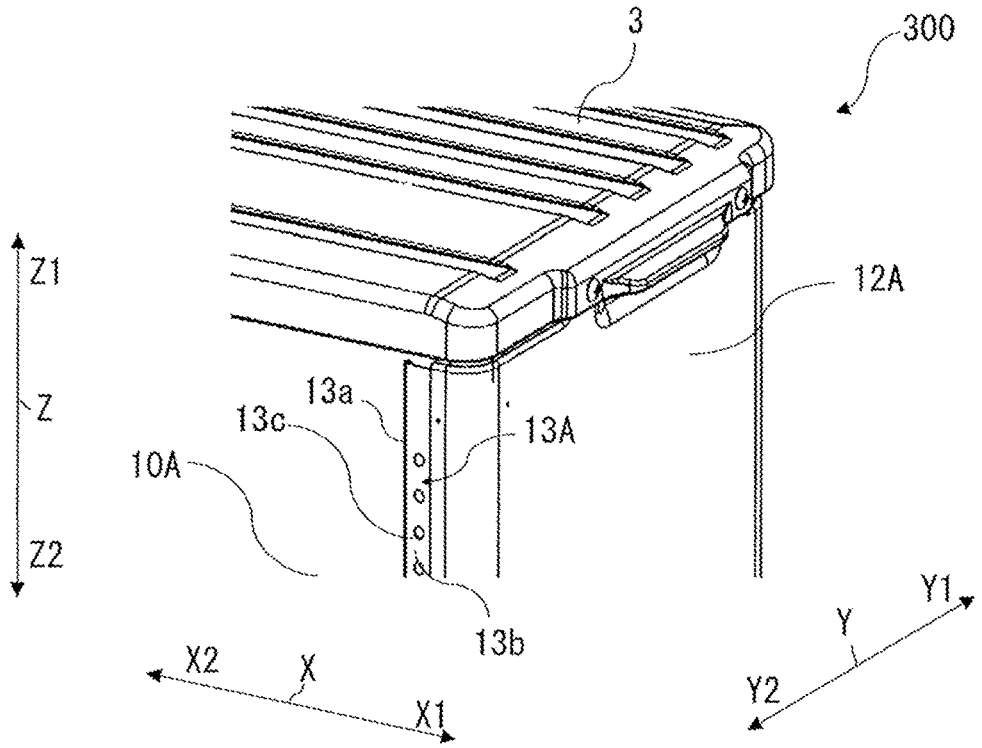
FIG. 17 is a rear perspective view of the outdoor unit according to Embodiment 2 of the present disclosure and illustrates the shape of each vent.
Figure 18:
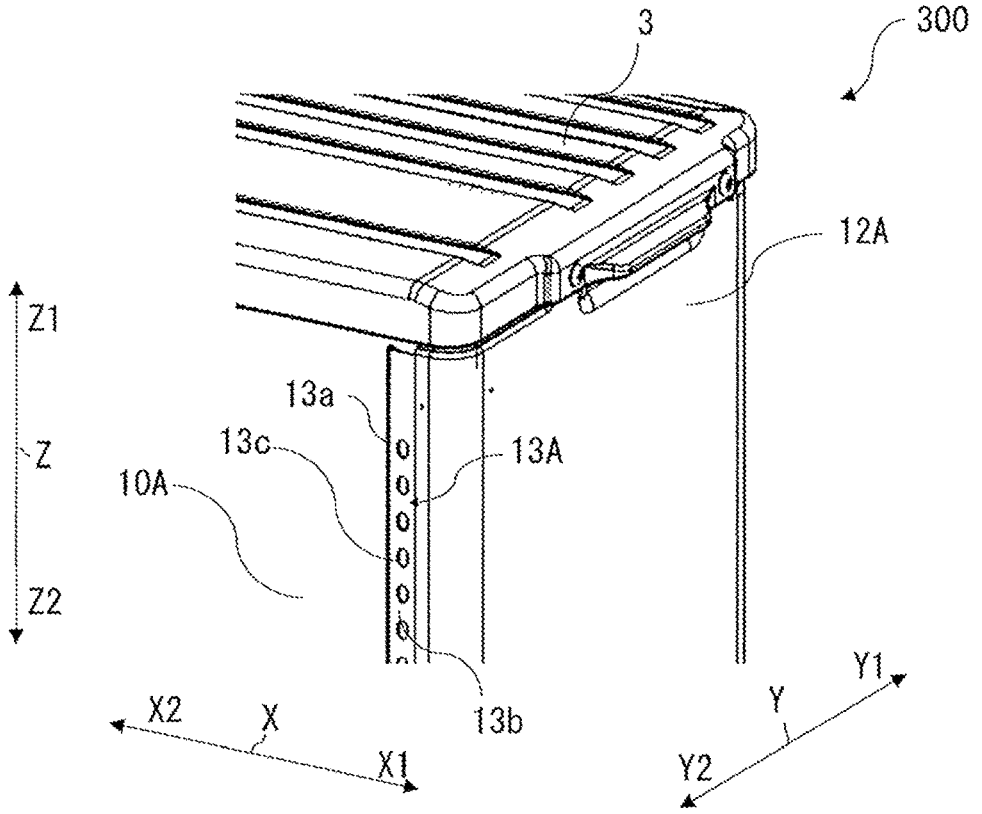
FIG. 18 is a rear perspective view illustrating Modification 1 of the vent of the outdoor unit according to Embodiment 2 of the present disclosure.
Figure 19:
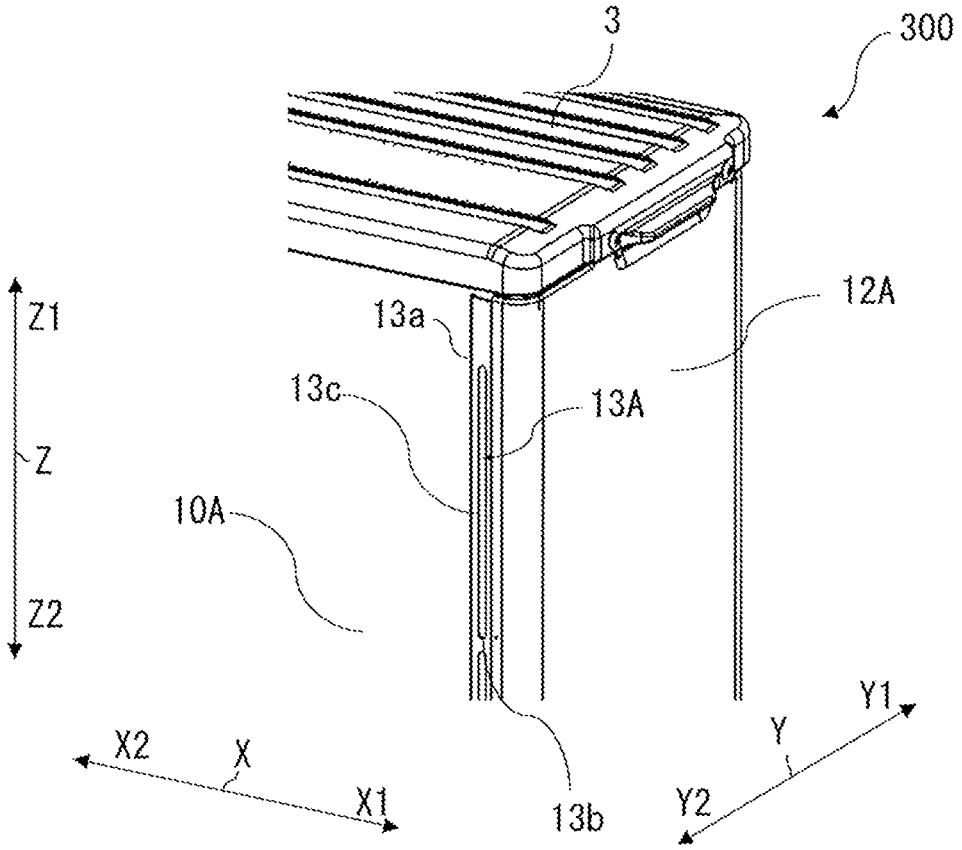
FIG. 19 is a rear perspective view illustrating Modification 2 of the vent of the outdoor unit according to Embodiment 2 of the present disclosure.

FIG. 17 is a rear perspective view of the outdoor unit 300 according to Embodiment 2 of the present disclosure and illustrates the shape of the vent 13*c*. FIG. 18 is a rear perspective view illustrating Modification 1 of the vent 13*c* of the outdoor unit 300 according to Embodiment 2 of the present disclosure. FIG. 19 is a rear perspective view illustrating Modification 2 of the vent 13*c* of the outdoor unit 300 according to Embodiment 2 of the present disclosure. FIGS. 17, 18, and 19 are enlarged views of part C in FIG. 12. The vent 13*c* is a through-hole in the rear portion 13A. As illustrated in FIG. 17, the vent 13*c* has a circular shape. However, it is only required that the vent 13*c* is a through-hole. For example, the vent 13*c* may have a corner-rounded rectangular shape as illustrated in FIG. 18, an oblong shape as illustrated in FIG. 19, or another shape, such as a perfectly circular shape, an oval shape, an obround shape, a rectangular shape, and a polygonal shape. The number of vents 13*c* of the rear portion 13A may be one or more. The diameter and area of the vent 13*c* or the number of vents 13*c* is determined in relation to the distance between the rear portion 13A and the fins 10*a*, and is a matter of design choice. The vent 13*c* is an air inlet of the casing 50 through which air is caused to enter the casing 50 from the outside by actuating the air-sending device 5.

[Operation of Outdoor Unit 300]

A common operation of the outdoor unit 300 according to Embodiment 2 of the present disclosure and the outdoor unit 400 according to Comparative Example will be described below. For each of the outdoor units 300 and 400, while the outdoor unit is being driven, the air-sending device 5 is driven to increase the efficiency of heat exchange between refrigerant flowing through the heat exchanger 10A and outdoor air. The air-sending device 5 creates a negative pressure between the heat exchanger 10A and a propeller fan 5*b* to introduce outdoor air 27 into the casing 50 from the rear (located farthest in the Y2 direction) of the casing 50. Then, the air-sending device 5 causes the air introduced into the casing 50 and subjected to heat exchange to be discharged, as blown air 28, out of the casing 50 through the air outlet 8 located in the front (located farthest in the Y1 direction) of the casing 50. At this time, suction air 27*a* flows into the casing 50 of each of the outdoor units 300 and 400 through the rear opening 7. The suction air 27*a* entering the casing 50 flows through the spaces between the fins 10*a* of the heat exchanger 10 and exchanges heat with the refrigerant flowing through the insides of heat transfer tubes 10*c*.

An operation of the outdoor unit 400 according to Comparative Example will be described below. Suction air 27*b*, which is part of the outdoor air 27 entering through the air inlet defined by the rear opening 7, enters a gap between the side edge part 13*a* and the rear area 10*f* of the heat exchanger 10 without passing through the spaces between the fins 10*a*. The suction air 27*b* entering the gap between the side edge part 13*a* and the rear area 10*f* passes through a space between the rear portion 13A and the rear area 10*f* in the direction in which the fins 10*a* are arranged. At this time, the flow of the suction air 27*b* in the direction in which the fins 10*a* are arranged causes turbulence of the air or vortices of air at the edges of the fins 10*a*, generating noise, such as a high-pitched sound like a peep.

At the end fin group 10*a*1 facing the overlapping region 13*b* in the outdoor unit 400, the suction air 27*b* flows in the direction in which the fins 10*a* are arranged and then flows around the outermost fin 10*a*2. This flow makes it difficult for the suction air 27*a* to flow through the spaces between the fins 10*a* at the end 10*t* of the heat exchanger 10A. The outdoor unit 400 may fail to fully demonstrate its heat exchange capacity at the end 10*t*.

In contrast, the outdoor unit 300 according to Embodiment 2 of the present disclosure has the vent 13*c* in the overlapping region 13*b* of the rear portion 13A. The vent 13*c* also allows the suction air 27*a* to enter the casing 50 through the vent 13*c*. As described above, in the case where the rear portion 13A has no vent 13*c*, the suction air 27*b* entering the gap between the side edge part 13*a* and the rear area 10*f* passes through the space between the rear portion 13A and the rear area 10*f*, causing noise. In the outdoor unit 300, the vent 13*c* of the rear portion 13A allows the suction air 27*a* to flow in a direction perpendicular to the direction in which the fins 10*a* are arranged. Therefore, the suction air 27*a* flows straight through the spaces between the fins 10*a*, which define the rear area 10*f*, and thus readily passes through the heat exchanger 10A with a low air flow resistance. Thus, the suction air 27*a* passing through the vent 13*c* is less likely to cause turbulence of the air or vortices of air, and thus causes no air-induced noise in the outdoor unit 300.

As the suction air 27*a* flows straight through the spaces between the fins 10*a*, which define the rear area 10*f*, with a low air flow resistance, the outdoor air 27 hardly enters the gap, which has a high air flow resistance, between the side edge part 13*a* and the rear area 10*f*. Thus, the suction air 27*b* is less likely to flow through the gap between the side edge part 13*a* and the rear area 10*f*, eliminating air-induced noise in the outdoor unit 300. Furthermore, even if the outdoor air 27 enters the gap between the side edge part 13*a* and the rear area 10*f*, the flow of the suction air 27*b* in the direction in which the fins 10*a* are arranged will be interrupted by the suction air 27*a* flowing straight with a low air flow resistance. Therefore, the suction air 27*b* is less likely to flow through the gap between the side edge part 13*a* and the rear area 10*f*, thus eliminating air-induced noise in the outdoor unit 300. Even if the suction air 27*b* passing past the side edge part 13*a* causes a vortex of air, the vortex will be canceled by the suction air 27*a* passing through the vent 13*c* and flowing straight.

In the above-described outdoor unit 400, as the suction air 27*b* entering the gap between the side edge part 13*a* and the rear area 10*f* passes through the space between the rear portion 13A and the rear area 10*f* in the direction in which the fins 10*a* are arranged, the suction air 27*b* hardly passes through the spaces between the fins 10*a* of the heat exchanger 10A. In the outdoor unit 300, however, the suction air 27*a* flows straight through the spaces between the fins 10*a*, which define the rear area 10*f*, and thus readily passes through the heat exchanger 10A with a low air flow resistance. Therefore, the outdoor unit 300 demonstrates higher heat exchange capacity at the end 10*t* of the heat exchanger 10A than does the outdoor unit 400 according to Comparative Example.

Figure 20:
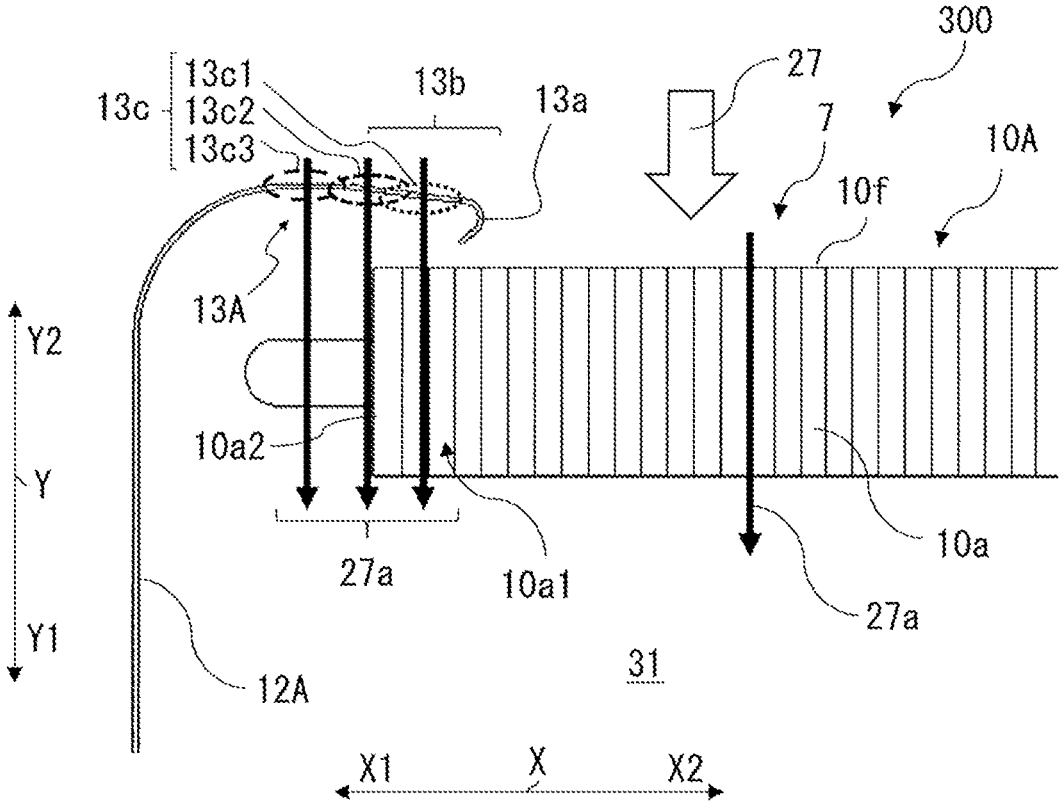
FIG. 20 is a top schematic diagram illustrating the end of the heat exchanger and explaining the position of the vent in FIG. 16.
Figure 21:
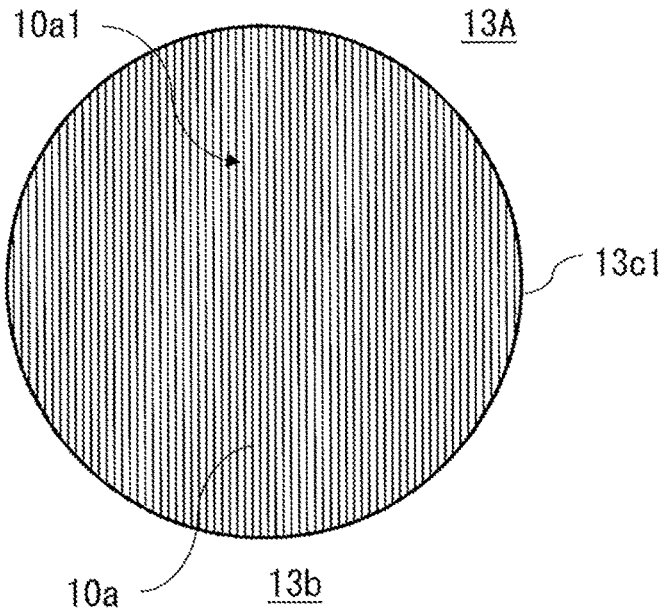
FIG. 21 is a schematic diagram of a vent in FIG. 20.
Figure 22:
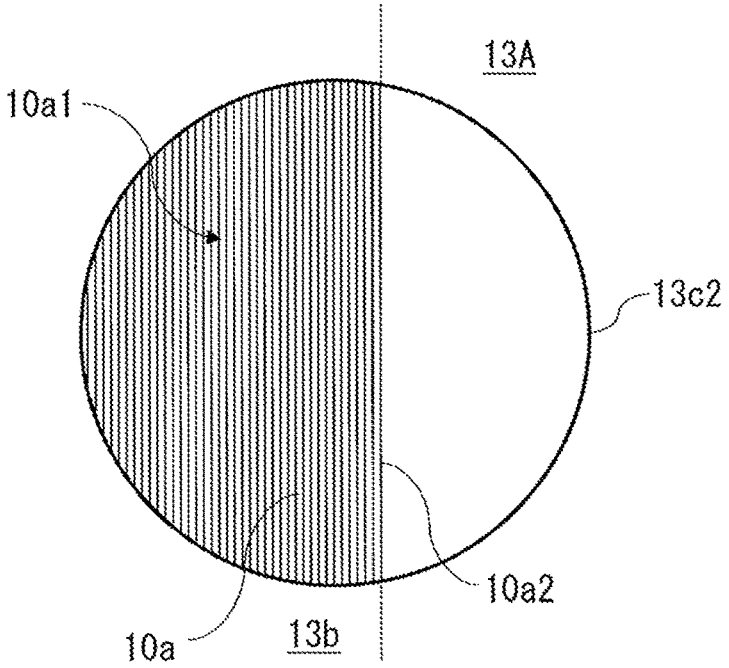
FIG. 22 is a schematic diagram of another vent in FIG. 20.

FIG. 20 is a top schematic diagram illustrating the end 10*t* of the heat exchanger 10A and explaining the position of the vent 13*c* in FIG. 16. FIG. 21 is a schematic diagram of a vent 13*c*1 in FIG. 20. FIG. 22 is a schematic diagram of another vent 13*c*2 in FIG. 20. A desired position of the vent 13*c* in the rear portion 13A will be described below with reference to FIGS. 20 to 22. For the position of the vent 13*c* in the rear portion 13A, three positions of the vent 13*c*1, the vent 13*c*2, and a vent 13*c*3 are conceivable.

The vent 13*c*1 is a through-hole that is fully located in the overlapping region 13*b*. Therefore, the whole of a space defined by an inner edge of the vent 13*c*1 faces the rear area 10*f* of the heat exchanger 10A. In other words, as illustrated in FIG. 21, only the fins 10*a* are arranged in the vent 13*c*1 when the vent 13*c*1 is viewed in the direction perpendicular to the rear portion 13A. Therefore, the suction air 27*a* passing through the vent 13*c*1 passes through the rear area 10*f* of the heat exchanger 10. As a result, the outdoor unit 300 having the vent 13*c*1 reduces or eliminates air-induced noise and demonstrates higher heat exchange capacity at the end 10*t* of the heat exchanger 10A than does the outdoor unit 400 according to Comparative Example.

Furthermore, the amount of suction air 27*a* that passes through the heat exchanger 10A in the outdoor unit 300 having the vent 13*c*1 is greater than that in the outdoor unit 300 having the vent 13*c*2. Therefore, the outdoor unit 300 having the vent 13*c*1 demonstrates higher heat exchange capacity at the end 10*t* of the heat exchanger 10A than does the outdoor unit 300 having the vent 13*c*2.

The vent 13*c*2 is a through-hole that has at least part that overlaps the overlapping region 13*b*. Therefore, part of a space defined by an inner edge of the vent 13*c*2 faces the rear area 10*f* of the heat exchanger 10A. In other words, as illustrated in FIG. 22, the outermost fin 10*a*2 is located in the vent 13*c*2 when the vent 13*c*2 is viewed in the direction perpendicular to the rear portion 13A. Therefore, the suction air 27*a* passing through the vent 13*c*2 partly passes through the rear area 10*f* of the heat exchanger 10A, and partly flows into the air-sending device chamber 31 without passing through the rear area 10*f* of the heat exchanger 10A. As a result, the vent 13*c*2 reduces or eliminates air-induced noise and allows the heat exchange capacity at the end 10*t* of the heat exchanger 10A to be higher than that in the outdoor unit 400 according to Comparative Example.

Furthermore, the amount of suction air 27*a* that does not pass through the heat exchanger 10A in the outdoor unit 300 having the vent 13*c*2 is greater than that in the outdoor unit 300 having the vent 13*c*1. Therefore, the amount of suction air 27*a* passing through the vent 13*c*2 is greater than that of suction air 27*a* passing through the vent 13*c*1. Thus, suction air 27*b* is less likely to flow through the gap between the side edge part 13*a* and the rear area 10*f* in the outdoor unit 300 having the vent 13*c*2 than does that in the outdoor unit 300 having the vent 13*c*1, further reducing the likelihood that the outdoor unit 300 having the vent 13*c*2 will generate air-induced noise. The ratio of the area of part of the vent 13*c*2 that is located in the overlapping region 1*b* to the area of part of the vent 13*c*2 that is not located in the overlapping region 1*b* is determined in relation to the gap between the rear portion 13A and the fins 10*a*, and is a matter of design choice.

The vent 13*c*3 is located in a region other than the overlapping region 13*b* and between the side edge part 13*a* and the rear portion 13A in the direction of width of the outdoor unit 300 (along the X axis). Therefore, the whole of a space defined by an inner edge of the vent 13*c*3 does not face the fins 10*a*, which define the rear area 10*f* of the heat exchanger 10A. Thus, the suction air 27*a* passing through the vent 13*c*3 flows into the air-sending device chamber 31 without passing through the spaces between the fins 10*a*, which define the rear area 10*f* of the heat exchanger 10.

The amount of suction air 27*a* that does not pass through the heat exchanger 10A in the outdoor unit 300 having the vent 13*c*3 is greater than that in the outdoor unit 300 having the vent 13*c*1 or 13*c*2. Therefore, the amount of suction air 27*a* passing through the vent 13*c*2 is greater than that of suction air 27*a* passing through the vent 13*c*1 or 13*c*2. Thus, suction air 27*b* hardly flows through the gap between the side edge part 13*a* and the rear area 10*f* even in the outdoor unit 300 having the vent 13*c*3, so that air may hardly induce noise.

At the position of the vent 13*c*3, the rear area 10*f* of the heat exchanger 10A, which is a resistor to the flow of air, does not exist in the direction in which the suction air 27*a* flows. Therefore, the suction air 27*a* enters the casing 50 more readily than does that in the outdoor unit 300 having the vent 13*c*1 and than does that in the outdoor unit 300 having the vent 13*c*2. For the position of the vent 13*c*3, however, the suction air 27*a* passing through the vent 13*c*3 does not pass through the heat exchanger 10A, resulting in a reduction in heat exchange capacity of the heat exchanger 10A. From the viewpoint of the heat exchange capacity of the heat exchanger 10A, therefore, the vent 13*c* of the outdoor unit 300 is more preferably located at the position of the vent 13*c*1 or the vent 13*c*2 than at the position of the vent 13*c*3.

[Advantageous Effects of Outdoor Unit 300]

In the outdoor unit 300, suction air 27*a* entering through the vent 13*c* flows straight through the spaces between the fins 10*a*. This flow causes suction air 27*a* entering the casing 50 through the rear opening 7, used as an air inlet, to hardly enter the gap, which has a higher air flow resistance than does the vent 13*c*, between the side edge part 13*a* of this air inlet and the fins 10*a*. As a result, suction air 27*b* is kept from flowing through the gap between the casing 50 and the heat exchanger 10A in the direction in which the fins 10*a* are arranged, thus reducing or eliminating turbulence of the air or vortices of air. Thus, the outdoor unit 300 does not generate noise induced by air that enters the casing 50 through the rear opening 7. Even if suction air 27*a* enters the gap between the side edge part 13*a* and the fins 10*a*, suction air 27*b* flowing in the direction in which the fins 10*a* are arranged will be interrupted by suction air 27*a* passing through the vent 13*c* and flowing straight. As a result, the suction air 27*b* is kept from flowing through the gap between the casing 50 and the heat exchanger 10A in the direction in which the fins 10*a* are arranged, thus reducing or eliminating turbulence of the air or vortices of air. Thus, the outdoor unit 300 does not generate noise induced by air that enters the casing 50 through the rear opening 7. Even if the suction air 27*b* passing past the side edge part 13*a* causes a vortex of air, the vortex will be canceled by the suction air 27*a* passing through the vent 13*c* and flowing straight. Thus, the outdoor unit 300 does not generate noise induced by air that enters the casing 50 through the rear opening 7. Additionally, in the outdoor unit 300, the suction air 27*a* flows straight through the spaces between the fins 10*a*, which define the rear area 10*f*, and thus readily passes through the heat exchanger 10 with a low air flow resistance. Thus, the outdoor unit 300 demonstrates higher heat exchange capacity at the end 10*t* of the heat exchanger 10 than does the outdoor unit 400 according to Comparative Example.

For the vent 13*c*2, at least part of this hole is located in the overlapping region 13*b*. In other words, the outermost fin

10*a*2 is located in the vent 13*c*2 when the vent 13*c*2 is viewed in the direction perpendicular to the rear portion 13A. Therefore, suction air 27*a* passing through the vent 13*c*2 partly passes through the end fin group 10*a*1 of the heat exchanger 10, and partly flows into the air-sending device chamber 31 without passing through the spaces between the fins 10*a* of the heat exchanger 10. As a result, the vent 13*c*2 reduces or eliminates air-induced noise and allows the heat exchange capacity at the end 10*t* of the heat exchanger 10A to be higher than that in the outdoor unit 200 according to Comparative Example.

When the vent 13*c*1 is viewed in the direction perpendicular to the rear portion 13A, only the fins 10*a* are arranged in this vent. Therefore, suction air 27*a* passing through the vent 13*c*1 readily passes through the spaces between the fins 10*a* at the end 10*t* of the heat exchanger 10A, whereas the suction air 27*a* hardly flows through the spaces between the fins 10*a* at the end 10*t* of the heat exchanger 10A in the outdoor unit 400 according to Comparative Example. As a result, the outdoor unit 300 having the vent 13*c*1 reduces or eliminates air-induced noise and demonstrates higher heat exchange capacity at the end 10*t* of the heat exchanger 10A than does the outdoor unit 400 according to Comparative Example.

The rear portion 13A having the vent 13*c* faces the front wall having the air outlet 8, through which air subjected to heat exchange is blown, and constitutes the rear wall of the air-sending device chamber 31. Such a configuration enables suction air 27*a* entering the outdoor unit 300 through the vent 13*c* to pass straight through the spaces between the fins 10*a* at the end 10*t* of the I-shaped heat exchanger 10A. The outdoor unit 300 includes the I-shaped heat exchanger 10A having a smaller number of fins 10*a* than does the L-shaped heat exchanger 10. Accordingly, the cost of parts of the outdoor unit 300 can be reduced as compared with that of an outdoor unit including the L-shaped heat exchanger 10. In addition to the above-described advantage in that the cost of parts of the outdoor unit 300 can be reduced, the outdoor unit 300 having the vent 13*c* reduces or eliminates air-induced noise.

The side edge part 13*a* is bent toward the fins 10*a*. This reduces the distance between the casing 50 and the heat exchanger 10A in the outdoor unit 300 to prevent the entry of, for example, a finger into the gap between the side edge part 12*a* and the heat exchanger 10, ensuring the safety of an operator.

The vent 13*c* has a circular, corner-rounded rectangular, or oblong shape. In the outdoor unit 300, therefore, the side edge part 13*a* adjacent to the vent 13*c* is hardly under localized high stress, thus enhancing the strength of the casing 50.

The configurations illustrated in the aforementioned embodiments are examples describing the present disclosure, and can be combined with another known technique or can be partly omitted or modified without departing from the spirit and scope of the present disclosure.

REFERENCE SIGNS LIST

1 shell panel 1A shell panel 1*a* side opening 1*b* region 1*c* vent 1*c*1 vent 1*c*2 vent 1*c*3 vent 2 side panel 2*a* second side part 2*b* second rear part 3 top panel 4 base 4*a* leg 5 air-sending device 5*a* motor 5*b* propeller fan 6 fan guard 7 rear opening 8 air outlet 10 heat exchanger 10A heat exchanger 10*a* fin 10*a*1 end fin group 10*a*2 outermost fin 10*b* fastening plate 10*c* heat transfer tube 10*e* side area 10*f* rear area 10*g* curved area 10*t* end 11 front portion 12 side portion 12A side portion 12*a* side edge part 13 rear portion 13A rear portion 13*a* side edge part 13*b* region 13*c* vent 13*c*1 vent 13*c*2 vent 13*c*3 vent 14 motor support 15 compressor 16 refrigerant pipe 17 partition 27 outdoor air 27*a* suction air 27*b* suction air 28 blown air 31 air-sending device chamber 32 machine chamber 50 casing 100 outdoor unit 200 outdoor unit 300 outdoor unit 400 outdoor unit

The invention claimed is:

1. An outdoor unit for an air-conditioning apparatus, the outdoor unit comprising:

a casing having at least one air inlet through which air enters the casing;

an air-sending device disposed in the casing and configured to create a flow of air passing through the at least one air inlet;

a heat exchanger disposed between the casing and the air-sending device and exposed through the at least one air inlet, the heat exchanger including a plurality of fins spaced apart from each other; and a partition disposed in the casing and dividing a space in the casing into an air-sending device chamber containing the heat exchanger and the air-sending device and a machine chamber containing a compressor, a plurality of fins including an end fin group located at an end of the heat exchanger remote from the partition, the casing including a wall having at least one vent that faces the end fin group and that is located along a side edge part defining an edge of the at least one air inlet, the heat exchanger being I-shaped when the heat exchanger is viewed in a direction perpendicular to a base on which the heat exchanger and the air-sending device are arranged, the wall having the at least one vent being opposite a front wall having an air outlet through which air subjected to heat exchange is blown, and constituting a rear wall of the air-sending device chamber.

2. The outdoor unit for an air-conditioning apparatus of claim 1, wherein the end fin group includes an outermost fin located at an extremity remote from the partition, wherein the wall has an overlapping region that is a wall part located between the side edge part and the outermost fin when the wall is viewed in a direction perpendicular to the wall, and wherein at least part of the at least one vent is located in the overlapping region.

3. The outdoor unit for an air-conditioning apparatus of claim 2, wherein the outermost fin is located in the at least one vent when the at least one vent is viewed in the direction perpendicular to the wall.

4. The outdoor unit for an air-conditioning apparatus of claim 2, wherein only the plurality of fins are arranged in the at least one vent when the at least one vent is viewed in the direction perpendicular to the wall.

5. The outdoor unit for an air-conditioning apparatus of claim 1, wherein the side edge part is bent toward the plurality of fins.

6. The outdoor unit for an air-conditioning apparatus of claim 1, wherein the at least one vent has a circular shape.

7. The outdoor unit for an air-conditioning apparatus of claim 1, wherein the at least one vent has a corner-rounded rectangular shape.

8. The outdoor unit for an air-conditioning apparatus of claim 1, wherein the at least one vent has an oblong shape.

9. The outdoor unit for an air-conditioning apparatus of claim 1, wherein the side edge part extends in the direction perpendicular to the base on which the heat exchanger and the air-sending device are arranged.

10. The outdoor unit for an air-conditioning apparatus of claim 9, wherein the vent is located between the side edge part and a side wall of the casing that is closest to the side edge part, the side wall of the casing connecting the front wall and the wall having the at least one vent.

11. The outdoor unit for an air-conditioning apparatus of claim 1, wherein the vent is located between the side edge part and a side wall of the casing that is closest to the side edge part, the side wall of the casing connecting the front wall and the wall having the at least one vent.

* * * * *